US010374286B2

(12) United States Patent
Park et al.

(10) Patent No.: US 10,374,286 B2
(45) Date of Patent: Aug. 6, 2019

(54) ANTENNA AND ELECTRONIC DEVICE INCLUDING THE SAME

(71) Applicant: Samsung Electronics Co., Ltd., Gyeonggi-do (KR)

(72) Inventors: Jung-Sik Park, Gyeonggi-do (KR); Yeon-Woo Kim, Gyeonggi-do (KR); Woo-Sup Lee, Gyeonggi-do (KR); Seung-Gil Jeon, Gyeonggi-do (KR); Ju-Seok Noh, Gyeonggi-do (KR); Jae-Bong Chun, Gyeonggi-do (KR); Hyun-Ju Hong, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 235 days.

(21) Appl. No.: 14/945,597

(22) Filed: Nov. 19, 2015

(65) Prior Publication Data

US 2016/0149290 A1 May 26, 2016

(30) Foreign Application Priority Data

Nov. 21, 2014 (KR) ..... 10-2014-0163512

(51) Int. Cl.

| | |
|---|---|
| ***H01Q 1/24*** | (2006.01) |
| ***H01Q 1/44*** | (2006.01) |
| *H01Q 9/42* | (2006.01) |

(52) U.S. Cl.

CPC ..... *H01Q 1/243* (2013.01); *H01Q 1/44* (2013.01); *H01Q 9/42* (2013.01)

(58) Field of Classification Search

CPC ..... H01Q 1/44; H01Q 1/343; H01Q 1/243; H01Q 1/245; H01Q 9/42

See application file for complete search history.

(56) References Cited

U.S. PATENT DOCUMENTS

| | | | | |
|---|---|---|---|---|
| 7,391,378 | B2 | 6/2008 | Mikkola et al. | |
| 7,936,307 | B2 | 5/2011 | Pang et al. | |
| 8,090,423 | B2 | 1/2012 | Na et al. | |
| 8,134,507 | B2 | 3/2012 | Chen et al. | |
| 8,270,914 | B2 | 9/2012 | Pascolini et al. | |
| 2007/0164915 | A1* | 7/2007 | Nevermann ..... | H01Q 1/243 343/702 |

(Continued)

FOREIGN PATENT DOCUMENTS

| | | |
|---|---|---|
| CN | 101013898 A | 8/2007 |
| CN | 102142597 A | 8/2011 |
| CN | 103036074 A | 4/2013 |

OTHER PUBLICATIONS

European Search Report dated Mar. 10, 2016.

(Continued)

*Primary Examiner* — Jessica Han
*Assistant Examiner* — Awat M Salih
(74) *Attorney, Agent, or Firm* — Cha & Reiter, LLC.

(57) ABSTRACT

An electronic device comprising: a housing; a wireless communication transceiver provided within the housing; an antenna radiator provided within the housing; and a cover arranged to cover at least a portion of the antenna radiator and form at least a portion of a surface of the housing, wherein the cover includes a conductive material, and the cover is at least partially detachable from the housing.

8 Claims, 21 Drawing Sheets

(56) References Cited

U.S. PATENT DOCUMENTS

| | | | | |
|---|---|---|---|---|
| 2009/0069061 | A1* | 3/2009 | Laurent | H01Q 1/245 455/575.7 |
| 2010/0009728 | A1* | 1/2010 | Koshi | H01Q 1/243 455/575.3 |
| 2011/0068984 | A1* | 3/2011 | Han | B29C 45/14065 343/702 |
| 2012/0168517 | A1* | 7/2012 | Lee | H01Q 1/243 235/492 |
| 2012/0175165 | A1 | 7/2012 | Merz et al. | |
| 2012/0262357 | A1 | 10/2012 | Kato et al. | |
| 2012/0274523 | A1* | 11/2012 | Ayatollahi | H01Q 1/243 343/745 |
| 2013/0088390 | A1 | 4/2013 | Wang | |
| 2013/0241800 | A1* | 9/2013 | Schlub | H01Q 1/243 343/893 |
| 2013/0321219 | A1* | 12/2013 | Cho | H01Q 1/243 343/702 |
| 2014/0168021 | A1* | 6/2014 | Park | H01Q 1/36 343/749 |
| 2016/0111771 | A1* | 4/2016 | Su | H01Q 1/243 343/702 |

OTHER PUBLICATIONS

European Search Report dated Jun. 27, 2017.
European Search Report dated Apr. 6, 2018.
European Informal Communication dated Oct. 3, 2018.
Chinese Search Report dated Mar. 20, 2019.

* cited by examiner

| | | | | | |
|---|---|---|---|---|---|
| Hand effects | Original | 13.1 | 12.1 | 14.5 | 13.2 |
| | Tunable IC Application | 15.1 | 13.5 | 15.0 | 14.7 |
| | Δ | +2.0 | +1.6 | +0.5 | +1.5 |

FIG.4E

ANTENNA AND ELECTRONIC DEVICE INCLUDING THE SAME

CLAIM OF PRIORITY

This application claims the priority under 35 U.S.C. § 119(a) to Korean Application Serial No. 10-2014-0163512, which was filed in the Korean Intellectual Property Office on Nov. 21, 2014, the entire content of which is hereby incorporated by reference.

TECHNICAL FIELD

The present disclosure relates to an antenna in general, and more particularly to an electronic device including the antenna.

BACKGROUND

Recently, with the development of multimedia technologies, electronic devices that have multiple functions have appeared on the market. These electronic devices generally have a convergence function for complexly performing one or more functions.

The functions of the electronic devices have being diversified, and relatively appealing and portable devices are more competitive. For example, consumers prefer electronic devices which are light-weight, slim, short, and small-sized, and use a preferred textile material (for example, a metal) even though the electronic devices have the same function. Accordingly, attempts to develop an electronic device that is light-weight, slim, short, and small-sized while having the same or an excellent function as compared with other products has been repeated.

Such attempts have even been made on antennas that are used to transmit and receive electric waves. For example, many efforts have been made to develop an antenna that can contribute to efficiently securing a mounting space of an electronic device without being influenced by a surrounding material while being smoothly operated at various frequency bands.

Recent communication electronic devices may include various types of embedded antenna units arranged within the electronic devices. In particular, when metallic objects (for example, a metal case) and metallic components are located near an antenna, the metallic structure is operated as a radiation absorption body of the antenna in order to lower radiation efficiency and reduce a frequency band.

Although conventional electronic devices have a sufficient mounting space for an antenna and a sufficient separation distance for a metal, and use a dielectric material such as plastic for an external material of a product so that there is no difficulty in designing an antenna, recent electronic devices have a smaller space for mounting an antenna unit as the sizes thereof become smaller and slimmer, and the distances between surrounding metallic objects and metallic components have become closer.

Because the metallic structure significantly contributes to an appealing external appearance and the slimness of the device, as well as the improvement of a mechanical strength, several attempts to apply the metallic structure to a part of an electronic device (in particular, a case frame) have been consistently made.

However, in regards to the conventional embedded antenna units, it is difficult to satisfy requirements such as miniaturization, improvement of efficiency, and an operation in a wide band range in an extreme surrounding condition.

A conventional method for solving the problem can achieve a smooth performance of an antenna by arranging an antenna pattern such that the antenna pattern is as distant from a metallic object as possible in a narrow mounting space using an existing antenna unit by replacing a metal object at a part where an antenna is located with a dielectric injection-molded material, or by increasing the thickness of a part where an antenna is located. However, it is difficult to secure a space any more as a mounting space for an antenna becomes smaller if an antenna pattern is distant from a metallic component and a metallic object, and it is easy to secure radiation performance if the antenna is injection-molded but a discontinuity in design is present between a metal and an injection-molded part so that an external design of the electronic device may be hampered.

SUMMARY

According to aspects of the disclosure, an electronic device is provided comprising: a housing; a wireless communication transceiver provided within the housing; an antenna radiator provided within the housing; and a cover arranged to cover at least a portion of the antenna radiator and form at least a portion of a surface of the housing, wherein the cover includes a conductive material, and the cover is at least partially detachable from the housing.

According to aspects of the disclosure, an antenna is provided comprising: an antenna radiator coupled to a feeding line and a ground line; a metallic structure electrically coupled to the antenna radiator and arranged to contribute to an electrical length of the antenna; and at least one electric circuit interposed between the feeding line and the ground line, the electric circuit being arranged to compensate for a change in the electrical length of the antenna that occurs when the metallic structure is decoupled from the antenna radiator.

According to aspects of the disclosure, an electronic device is provided comprising: a housing including a metallic structure that forms at least a portion of an outer wall of the housing; an antenna radiator arranged in the housing and coupled to a feeding line and a ground line, wherein the metallic structure is coupled to the antenna radiator and arranged to contribute to a physical length of an antenna that is formed by the antenna radiator and the metallic structure; and at least one electric circuit interposed between the feeding line and the ground line, the at least one electric circuit being arranged to compensate for a change in the physical length of the antenna that occurs when the metallic structure is decoupled from the antenna radiator.

According to aspects of the disclosure, an electronic device is provided comprising: a housing including a metallic structure that forms at least a portion of an outer wall of the housing; a dielectric carrier arranged in the housing and coupled to a feeding line and a ground line; an antenna radiator arranged in the dielectric carrier and operated in at least one frequency band, wherein the metallic structure is coupled to the antenna radiator and arranged to contribute to a physical length of an antenna that is formed by the antenna radiator and the metallic structure; and at least one electric circuit interposed between the feeding line and the ground line to compensate for a change in the physical length of the antenna that occurs when the metallic structure is decoupled from the antenna radiator.

BRIEF DESCRIPTION OF THE DRAWINGS

The above and other aspects, features, and advantages of the present disclosure will be more apparent from the following detailed description taken in conjunction with the accompanying drawings, in which.

Figure 4A:
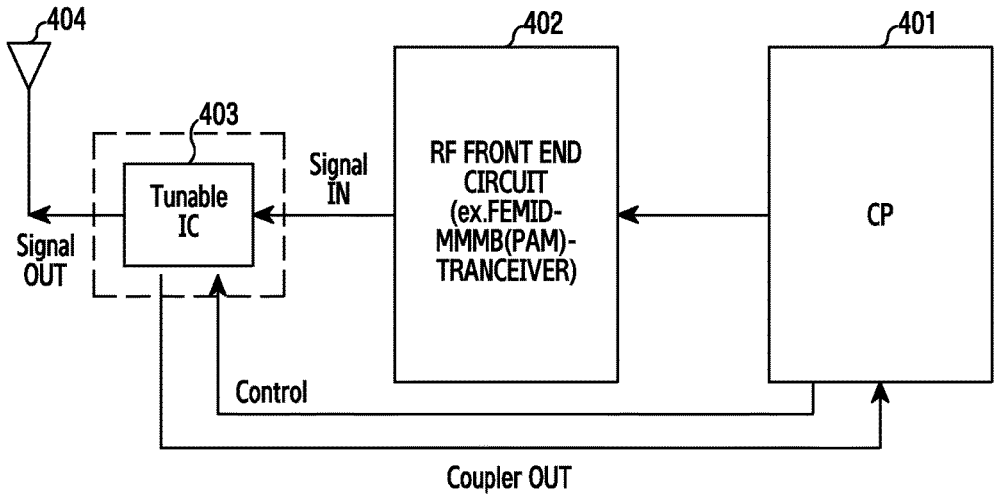
FIG. 4A is a block diagram of an example of an electronic device, according to various embodiments of the present disclosure.
Figure 4B:
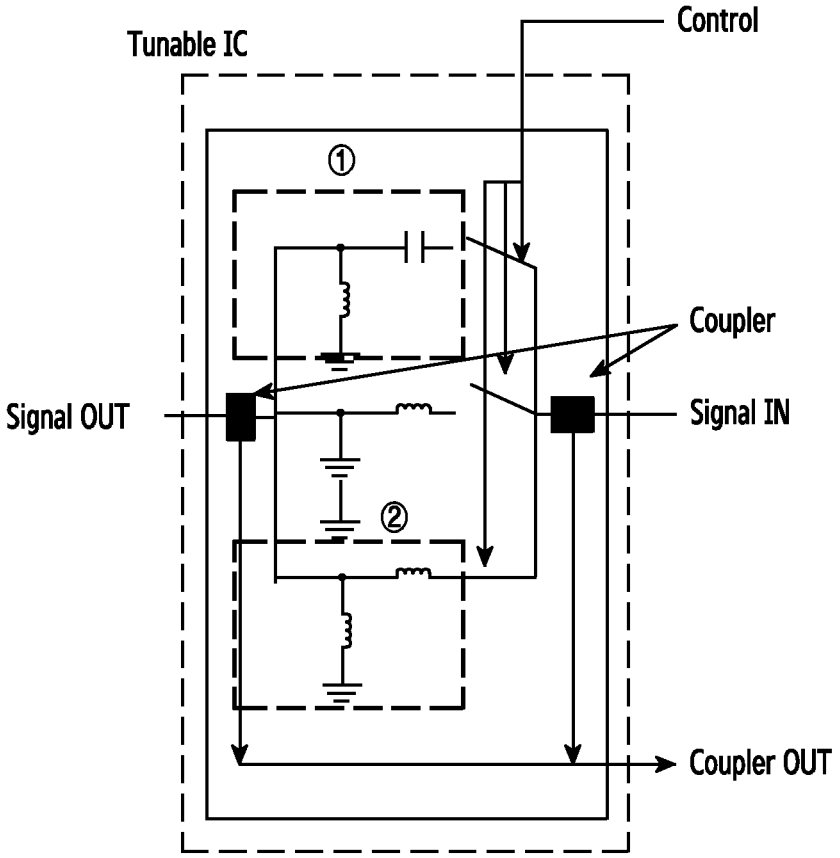
FIG. 4B is a diagram of an example of a circuit, according to various embodiments of the present disclosure.
Figure 5A:
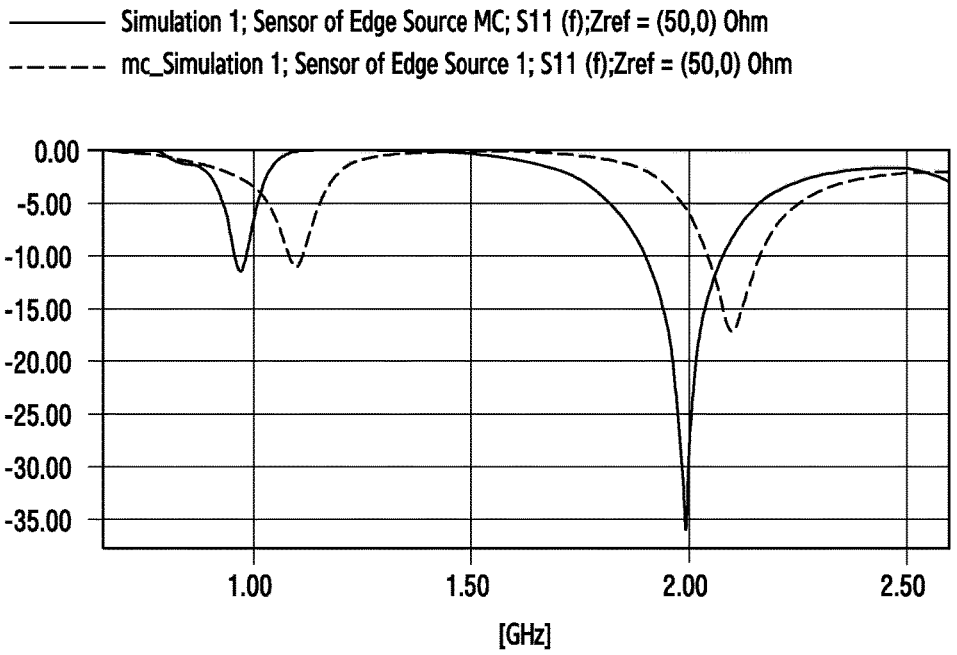
Figure 5B:
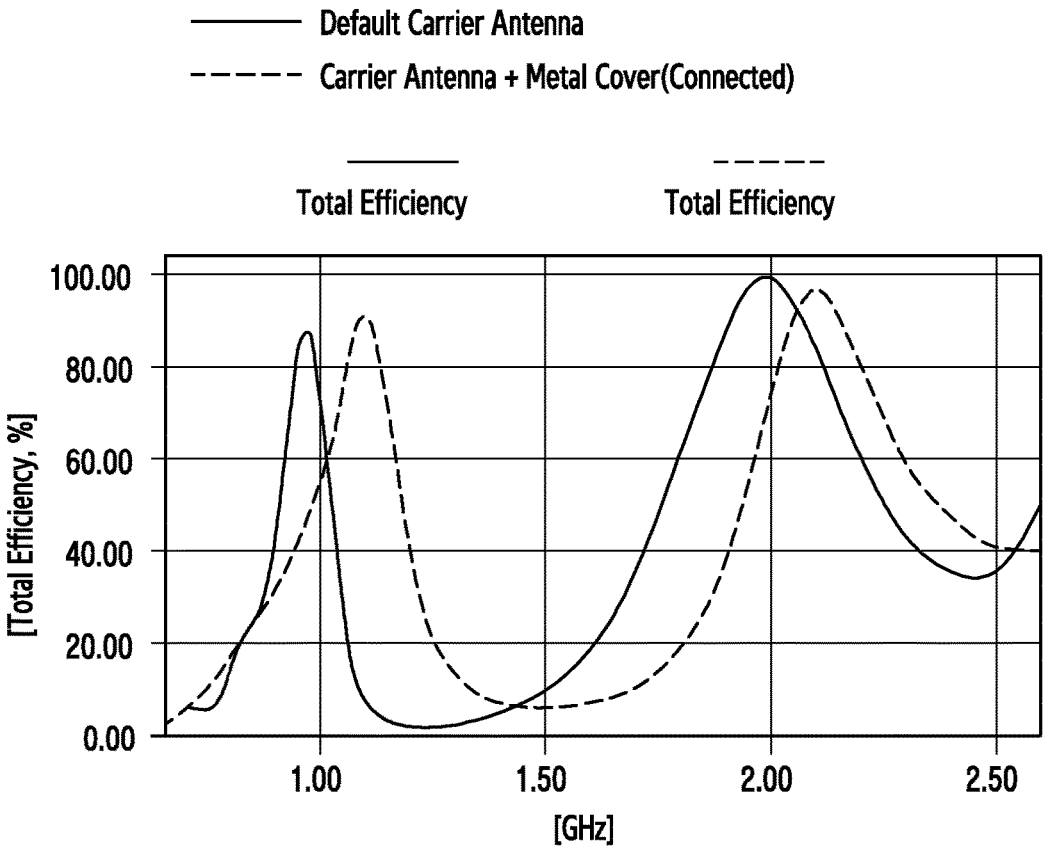
Figure 6:
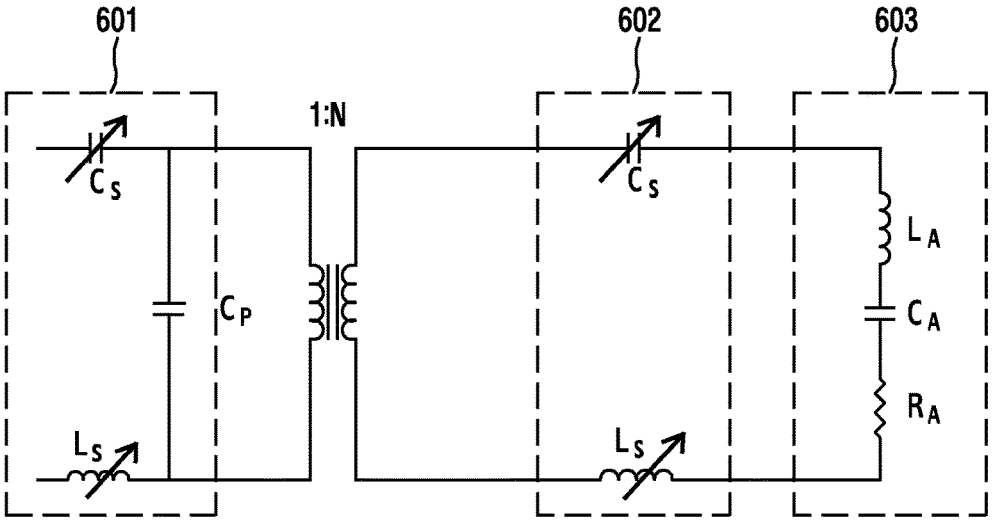
Figure 7A:
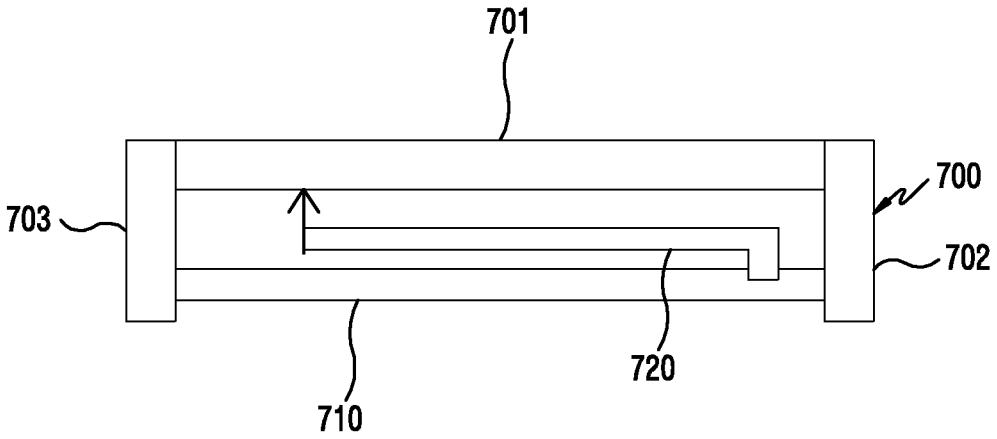
Figure 7B:
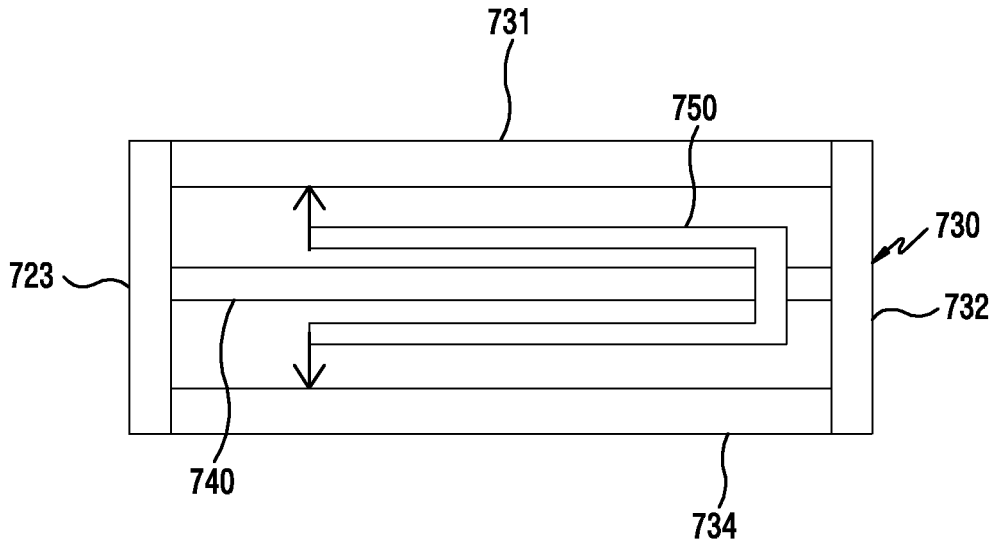
Figure 7C:
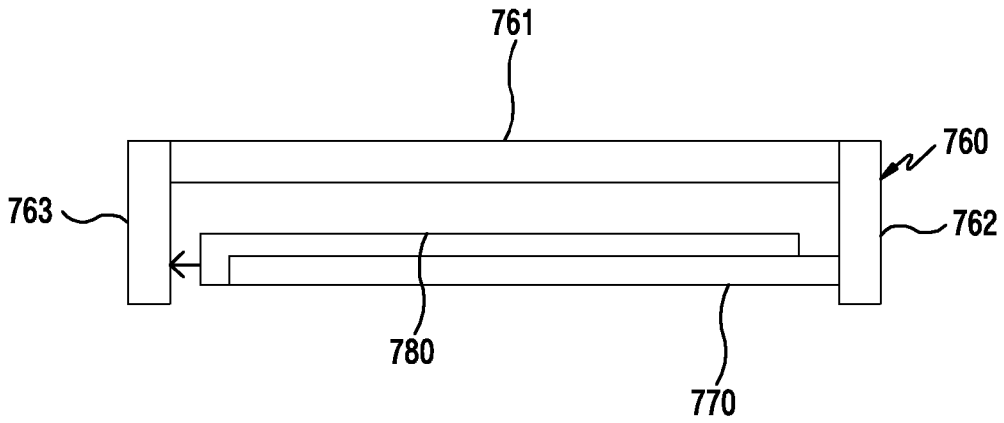
Figure 8:
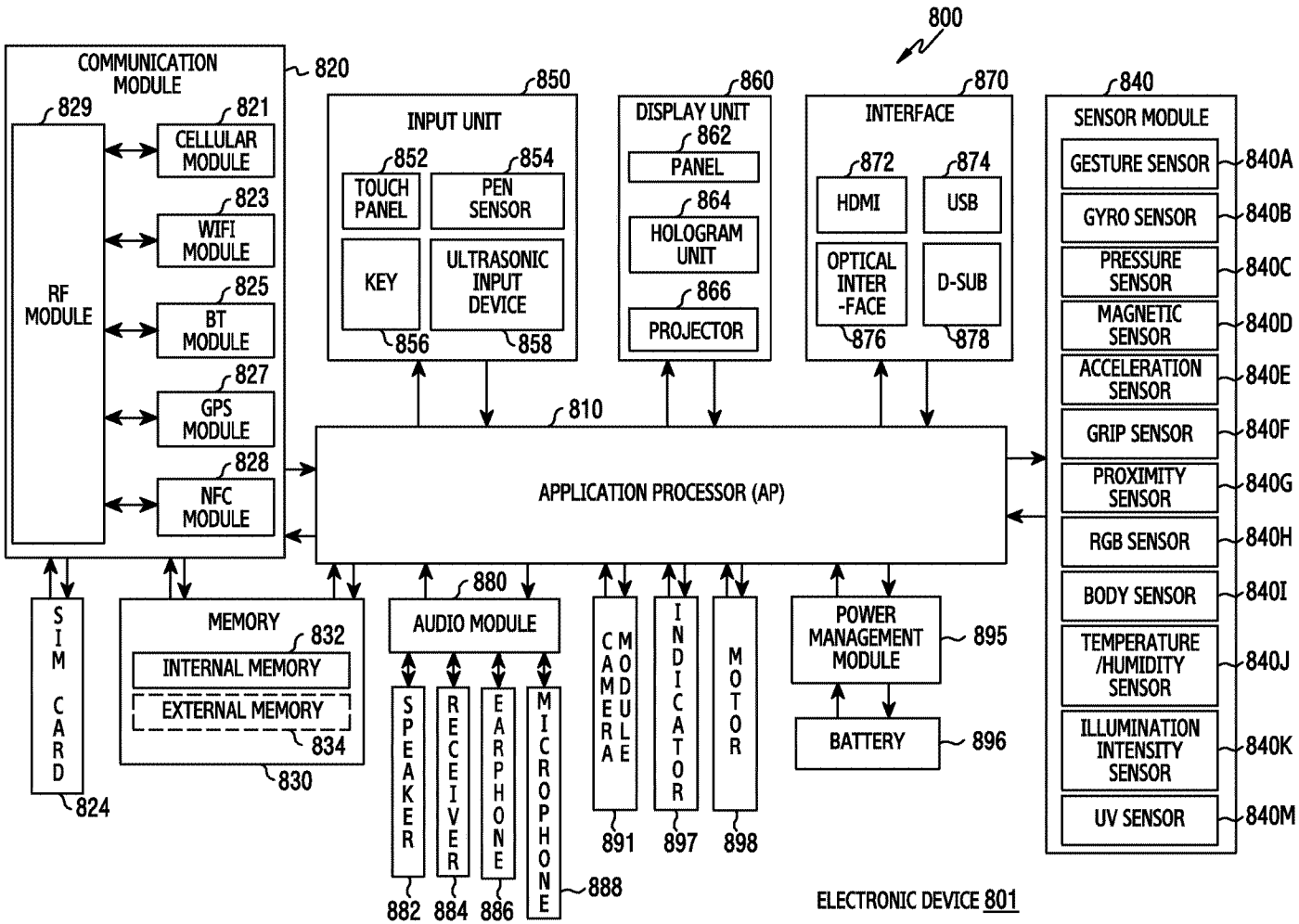

4D is a graph depicting a change in the operational frequency band by the electric circuit of FIG. 4B in which an e antenna radiator has an independent matching path according to various embodiments of the present disclosure;

FIG. 4E is a table illustrating different reductions in signal loss due to hand effect interference when an electric circuit (e.g., a tunable IC) is used, according to various embodiments of the present disclosure;

FIG. 5A is an S11 graph of an antenna, according to various embodiments of the present disclosure;

FIG. 5B is an S11 graph of an antenna, according to various embodiments of the present disclosure;

FIG. 6 is an example of an equivalent circuit diagram of an antenna employing a radiation cover, according to various embodiments of the present disclosure;

FIG. 7A is a diagram of an example of an antenna system, according to various embodiments of the disclosure;

FIG. 7B is a diagram of an example of an antenna system, according to various embodiments of the disclosure;

FIG. 7C is a diagram of an example of an antenna system, according to various embodiments of the disclosure; and FIG. 8 is a block diagram of an example of an electronic device, according to various embodiments of the present disclosure.

DETAILED DESCRIPTION

Hereinafter, various embodiments of the present disclosure will be described with reference to the accompanying drawings. The present disclosure may be modified in various forms and include various embodiments, but specific examples are illustrated in the drawings and described in the description. However, the description is not intended to limit the present disclosure to the specific embodiments, and it shall be appreciated that all the changes, equivalents and substitutions belonging to the idea and technical scope of the present disclosure are included in the present disclosure. In the description of the drawings, identical or similar reference numerals are used to designate identical or similar elements.

The term "include" or "may include" refers to the existence of a corresponding disclosed function, operation or component which can be used in various embodiments of the present disclosure and does not limit one or more additional functions, operations, or components. In the present disclosure, the terms such as "include" or "have" may be construed to denote a certain characteristic, number, step, operation, constituent element, component or a combination thereof, but may not be construed to exclude the existence of or a possibility of addition of one or more other characteristics, numbers, steps, operations, constituent elements, components or combinations thereof.

The term "or" used in various embodiments of the present disclosure includes any or all of combinations of listed words. For example, the expression "A or B" may include A, may include B, or may include both A and B.

The expression "1", "2", "first", or "second" used in various embodiments of the present disclosure may modify various components of various embodiments but does not limit the corresponding components. For example, the above expressions do not limit the sequence and/or importance of the elements. The above expressions are used merely for the purpose of distinguishing an element from the other elements. For example, a first user device and a second user device indicate different user devices although both of them are user devices. For example, without departing from the scope of the present disclosure, a first component element may be named a second component element. Similarly, the second component element also may be named the first component element.

It should be noted that if it is described that one component element is "coupled" or "connected" to another component element, the first component element may be directly coupled or connected to the second component, and a third component element may be "coupled" or "connected" between the first and second component elements. Contrarily, when an element is "directly coupled" or "directly connected" to another element, it may be construed that a third element does not exist between the first element and the second element.

The terms used in the present disclosure are used to describe a specific embodiment, and are not intended to limit the present disclosure. As used herein, the singular forms are intended to include the plural forms as well, unless the context clearly indicates otherwise.

Unless defined otherwise, all terms used herein, including technical and scientific terms, have the same meaning as commonly understood by those of skill in the art to which the present disclosure pertains. Such terms as those defined in a generally used dictionary are to be interpreted to have the meanings equal to the contextual meanings in the relevant field of art, and are not to be interpreted to have ideal or excessively formal meanings unless clearly defined in the present disclosure.

An electronic device according to various embodiments of the present disclosure may be a device including an antenna that enables a communication function in at least one frequency band. For example, the electronic device may include at least one of a smartphone, a tablet personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, a wearable device (e.g., a head-mounted-device (HMD) such as electronic glasses, electronic clothes, an electronic bracelet, an electronic necklace, an electronic appcessory, an electronic tattoo, or a smart watch).

According to some embodiments, the electronic device may be a smart home appliance. The smart home appliances may include at least one of, for example, televisions, digital video disk (DVD) players, audio players, refrigerators, air conditioners, cleaners, ovens, microwaves, washing machines, air purifiers, set-top boxes, TV boxes (e.g., HomeSync™ of Samsung, Apple TV™, or Google TV™), game consoles, electronic dictionaries, electronic keys, camcorders, or electronic frames.

According to some embodiments, the electronic device may include at least one of various medical devices {e.g., a magnetic resonance angiography (MRA), a magnetic resonance imaging (MRI), a computed tomography (CT) machine, and an ultrasonic machine}, navigation devices, global positioning system (GPS) receivers, event data recorders (EDR), flight data recorders (FDR), vehicle infotainment devices, electronic devices for ships (e.g., navigation devices for ships, and gyro-compasses), avionics, security devices, automotive head units, robots for home or industry, automatic teller's machines (ATMs) in banks, or point of sales (POS) in shops.

According to another embodiment, the electronic devices may include at least one of furniture or a part of a building/structure having a communication function, electronic boards, electronic signature receiving devices, projectors, or various measuring equipment (e.g., equipment for a water supply, an electricity, gases or radio waves). An electronic device according to various embodiments of the present disclosure may be a combination of one or more of above-described various devices. Also, an electronic device according to various embodiments of the present disclosure may be a flexible device. Also, an electronic device according to various embodiments of the present disclosure is not limited to the above-described devices.

Hereinafter, an electronic device according to various embodiments will be described with reference to the accompanying drawings. The term "user" used in various embodiments may refer to a person who uses an electronic device or a device (for example, an artificial intelligence electronic device) that uses an electronic device.

Figure 1:
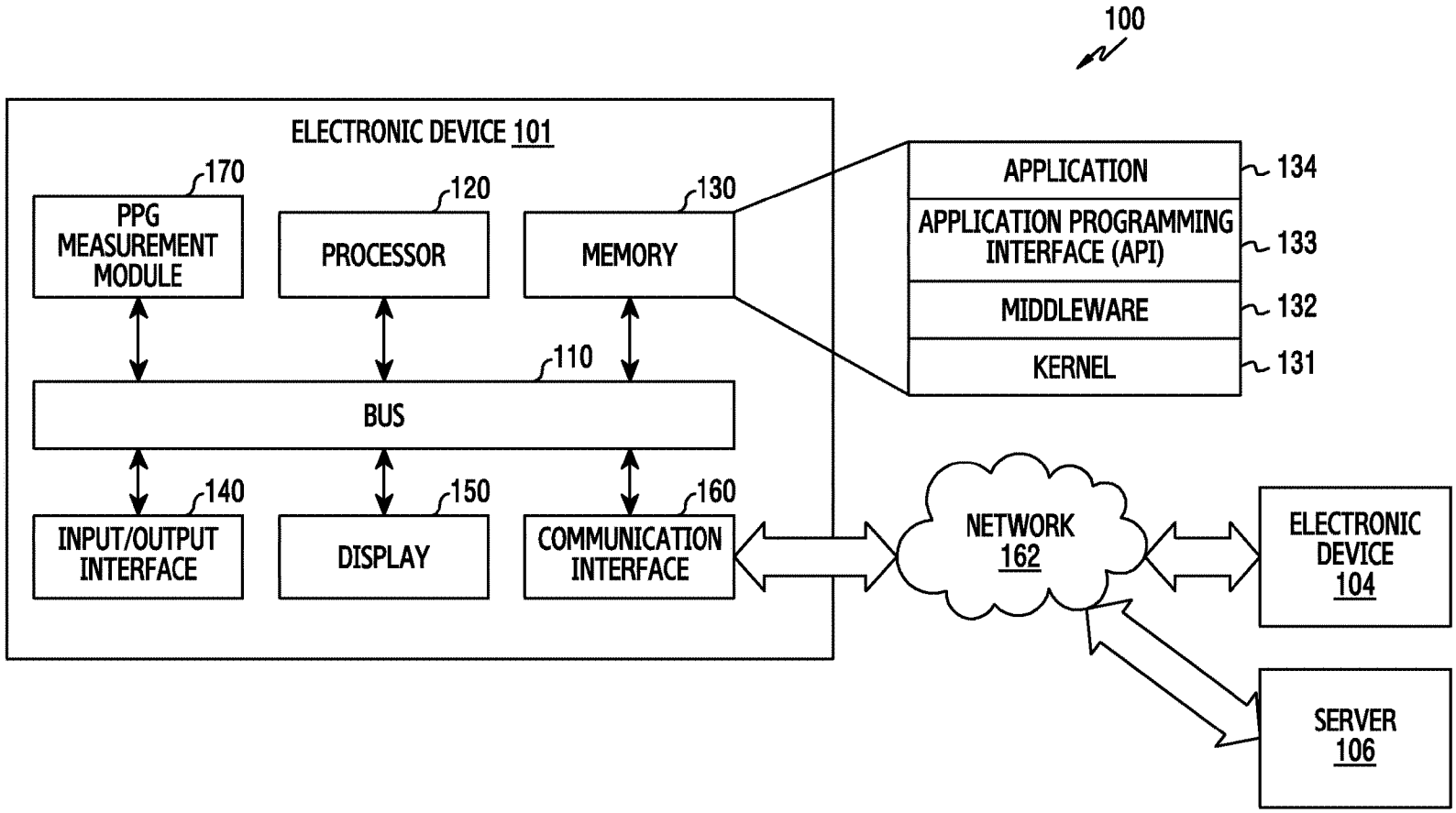
FIG. 1 is a diagram illustrating an example of a network environment, according to various embodiments of the present disclosure.

FIG. 1 is a diagram illustrating an example of a network environment 100 including an electronic device 101, according to various embodiments. Referring to FIG. 1, the electronic device 101 may include a bus 110, a processor 120, a memory 130, an input/output interface 140, a display 150, and a communication interface 160.

The bus 110 may be a circuit for connecting the aforementioned elements to each other and transmitting communication (e.g., a control message) between the aforementioned elements.

The processor 120 may include any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), etc. The processor 120 may, for example, receive instructions from other components (for example, the memory 130, the input/output interface 140, the display 150, and the communication interface 160) via the bus 110, analyze the received instructions, and execute calculations or data processing according to the analyzed instructions.

The memory 130 may include any suitable type of volatile or non-volatile memory, such as Random Access Memory (RAM), Read-Only Memory (ROM), Network Accessible Storage (NAS), cloud storage, a Solid State Drive (SSD), etc. The memory 130 may store instructions or data received from or created by the processor 120 or other elements (e.g., the input/output interface 140, the display 150, and the communication interface 160). The memory 130 may include programming modules, such as a kernel 131, middleware 132, an Application Programming Interface (API) 133, an application 134, and the like. The programming modules may be configured with software, firmware, hardware, or a combination of two or more thereof.

The kernel 131 may control or manage system resources (e.g., the bus 110, the processor 120, or the memory 130) used for executing an operation or a function implemented in the remaining other programming modules, for example, the middleware 132, the API 133, or the application 134. In addition, the kernel 131 may provide an interface through which the middleware 132, the API 133, or the applications 134 may control or manage the individual components of the electronic device 101 while accessing the individual components.

The middleware 132 may perform a relay function of allowing the API 133 or the application 134 to communicate with the kernel 131 to exchange data therewith. Furthermore, in regard to task requests received from the applications 134, the middleware 132 may perform a control (e.g., scheduling or load balancing) for the task requests, using a method of allocating at least one of the applications 134 a priority for using the system resources (e.g., the bus 110, the processor 120, and the memory 130) of the electronic device 101.

The API 133 is an interface through which the applications 134 may control functions provided by the kernel 131 and the middleware 132, and may include at least one interface or function (e.g., instruction) for file control, window control, image processing, or text control.

According to various embodiments, the applications 134 may include a Short Message Service (SMS)/Multimedia Message Service (MMS) application, an e-mail application, a calendar application, an alarm application, a health care application (e.g., an application for measuring an amount of exercise or blood sugar), and an environmental information application (e.g., an application for providing information on atmospheric pressure, humidity, temperature, and the like). Additionally or alternatively, the application 134 may include an application related to information exchange between the electronic device 101 and an external electronic device (e.g., an electronic device 104). The application related to exchanging information may include, for example, a notification relay application for transferring predetermined information to the external electronic device, or a device management application for managing the external electronic device.

For example, the notification relay application may include a function of transferring, to the external electronic device (e.g., the electronic device 104), notification information generated in other applications of the electronic device 101 (e.g., an SMS/MMS application, an e-mail application, a health management application, an environmental information application, and the like). Additionally or alternatively, the notification relay application may receive notification information from, for example, the external electronic device (e.g., the electronic device 104) and provide the received notification information to a user. For example, the device management application may manage (e.g., install, delete, or update) functions for at least a part of the external electronic device (e.g., the electronic device 104) communicating with the electronic device 101 (e.g., turning on/off the external electronic device itself (or some elements thereof) or adjusting brightness (or resolution) of a display), applications operating in the external electronic device, or services (e.g., a telephone call service or a message service) provided by the external electronic device.

According to various embodiments, the applications 134 may include an application set on the basis of an attribute (for example, a type) of the external electronic device (for example, the electronic device 104). For example, when the external electronic device is an MP3 player, the applications 134 may include an application related to the reproduction of music. Similarly, in cases where the external electronic device is a mobile medical appliance, the applications 134 may include an application related to health care. According to an embodiment, the applications 134 may include at least one of an application designated to the electronic device 101 and an application received from the external electronic device (e.g., a server 106 or the electronic device 104).

The input/output interface 140 may transfer instructions or data input from a user through an input/output device (e.g., a sensor, a keyboard, or a touchscreen) to the processor 120, the memory 130, and the communication interface 160 through, for example, the bus 110. For example, the input/output interface 140 may provide, to the processor 120, data for a user's touch which is input through the touchscreen. In addition, through the input/output device (e.g., a speaker or a display), the input/output interface 140 may output instructions or data received from the processor 120, the memory 130, or the communication interface 160 through the bus 110. For example, the input/output interface 140 may output voice data, processed through the processor 120, to a user through a speaker.

The display 150 may display various pieces of information (e.g., multimedia data or text data) to a user.

The communication interface 160 may connect communication between the electronic device 101 and the external electronic device (e.g., the electronic device 104 or the server 106). For example, the communication interface 160 may be connected to a network 162 through wireless or wired communication to communicate with the external device. The wireless communication may include at least one of, for example, Wi-Fi, Bluetooth (BT), Near Field Communication (NFC), a Global Positioning System (GPS), and cellular communication (for example, Long Term Evolution (LTE), Long Term Evolution-Advanced (LTE-A), Code Division Multiple Access (CDMA), Wideband CDMA (WCDMA), Universal Mobile Telecommunication System (UMTS), Wireless Broadband (WiBro), or Global System for Mobile communication (GSM)). The wired communication may include, for example, at least one of a universal serial bus (USB), a high definition multimedia interface (HDMI), recommended standard 232 (RS-232), and a plain old telephone service (POTS).

According to an embodiment, the network 162 may be a telecommunication network. The communication network may include at least one of a computer network, the Internet, the Internet of things, and a telephone network. According to one embodiment, a protocol (e.g., a transport layer protocol, data link layer protocol, or a physical layer protocol) for communication between the electronic device 101 and the external device may be supported by at least one of the application 134, the application programming interface 133, the middleware 132, the kernel 131, and the communication interface 160.

In the following description, a conductive cover (for example, a battery cover) of a metallic material that is applied to at least a portion of an external appearance of an electronic device will be described as a part of an antenna, but the present disclosure is not limited thereto. For example, various metallic structures arranged at various locations of an electronic device in various methods, and arranged around an antenna radiator, may be applied as a part of an antenna.

According to an embodiment, the metallic structure is applied to an external appearance of an electronic device so as to be exposed to the outside, but the present disclosure is not limited thereto. For example, the metallic structure may be arranged within an electronic device, or may be partially exposed to an electronic device.

Figure 2A:
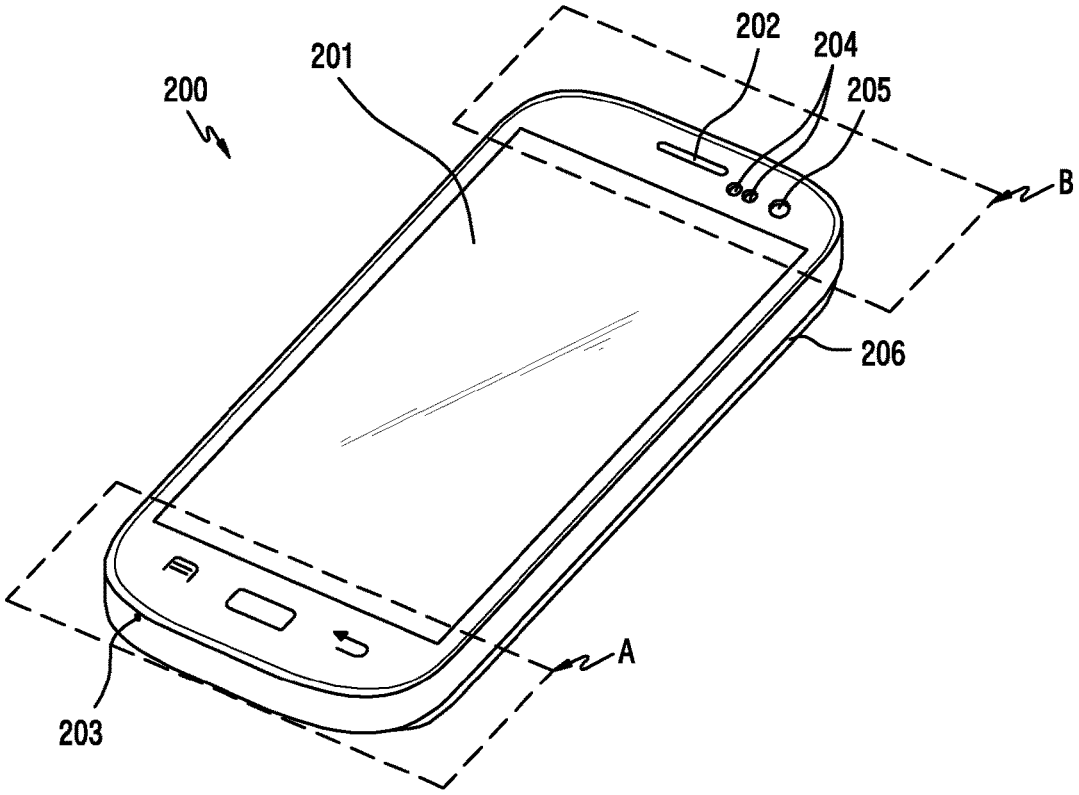
FIG. 2A is a perspective view of a front surface of an electronic device, according to various embodiments of the present disclosure.

FIG. 2A is a perspective view of a front surface of an electronic device 200 in which an antenna is installed, according to various embodiments of the present disclosure.

As illustrated, a display 201 may be installed on the front surface of the electronic device 200. A speaker unit 202 for outputting voice may be installed above the display 201. A microphone unit 203 for capturing voice may be installed below the display 201.

According to an embodiment, components for performing various functions of the electronic device 200 may be arranged around the speaker unit 202. The components may include a first camera unit 205 and at least one sensor module 204. The sensor module 204 may include, for example, an illumination intensity sensor (for example, an optical sensor) and/or a proximity sensor (for example, an optical sensor). According to an embodiment, although not illustrated, the components may further include, for example, at least one LED indicator.

According to an embodiment, an antenna may be arranged in area A or area B of the electronic device, depending on which one is least influenced when the electronic device 200 is gripped. However, the present disclosure is not limited thereto, and the antenna may be arranged in any other portion of the electronic device 200.

Figure 2B:
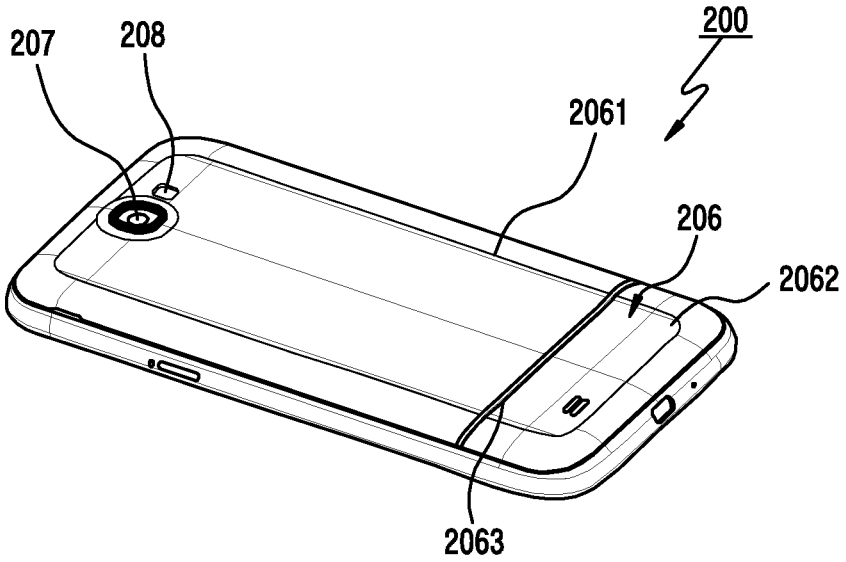
FIG. 2B is a perspective view of a rear surface of the electronic device of FIG. 1, according to various embodiments of the present disclosure.

FIG. 2B is a perspective view of a rear surface of the electronic device 200, according to various embodiments of the present disclosure. As illustrated, a battery cover 206 may be further installed on a rear surface of the electronic device. The battery cover 206 may be formed of a conductive material. According to an embodiment, the conductive material may include a metallic material. According to an embodiment, the conductive material may be arranged between area A and area B. According to an embodiment, the battery cover 206 may include a main cover 2061 and a radiation cover 2062. The main cover 2061 and the radiation cover 2062 may be arranged to be spaced apart from each other by a gap 2063. The main cover 2061 and the radiation cover 2062 of the metallic battery cover 206 may be either integrally or separately formed. When they are integrally formed, a separate connecting filler (for example, a resin, a rubber, silicon, urethane, or a composite material) may be provided in the gap 2063 to connect the main cover 2061 and the radiation cover 2062. According to an embodiment, the battery cover may be separable from the rest of the housing of the electronic device. According to another embodiment, the battery cover may be integral with the rest of the housing of the electronic device.

According to an embodiment, a second camera unit 207 for photographing an external subject and a flash 208 may be installed at an upper portion of a rear surface of the electronic device 200.

According to various embodiments of the present disclosure, an antenna radiator 230 (see FIG. 3A) may be provided within housing of the electronic device, and the antenna radiator 230 and the radiation cover 2062 may be electrically connected to each other in at least one area when the battery cover 206 is mounted on the electronic device. According to an embodiment, a physical (electrical) length of the antenna radiator 230 varies according to where the radiation cover 2062 and the antenna radiator 230 connect to each other. According to an embodiment, the antenna radiator and the radiation cover may by coupled to one another in any suitable manner. For example, the antenna radiator and the radiation cover may be electrically connected (e.g., directly or indirectly). As another example, the antenna radiator and the radiation cover may be electromagnetically coupled.

According to an embodiment, when the cover 206 is installed on the electronic device 200 and the radiation cover 2062 is coupled to the antenna radiator 230, the electronic device 200 may use both the radiation cover 2062 and the antenna radiator 230 as an antenna. On the other hand, when the radiation cover 2062 is decoupled from the antenna radiator 230, the electronic device 200 may use only the antenna radiator 230 as the antenna. Furthermore, in an embodiment, the electric circuit 240 (see FIG. 3A) is interposed between a feeding line (not illustrated) and a ground line of the antenna radiator 230 so that a resonance frequency and a matching state of the antenna may be changed when the radiation cover 2062 is separated from or coupled to the antenna radiator 230. Thus, as used throughout the disclosure, the term "antenna" may refer only to the antenna radiator 230 when the antenna radiator 230 is operated without the radiation cover 2062 (e.g., alone), or the combination of the antenna radiator 230 and the radiation cover 2062 when the radiation cover 2062 is used in conjunction with the antenna radiator 230 to transmit and receive signals.

Figure 3A:
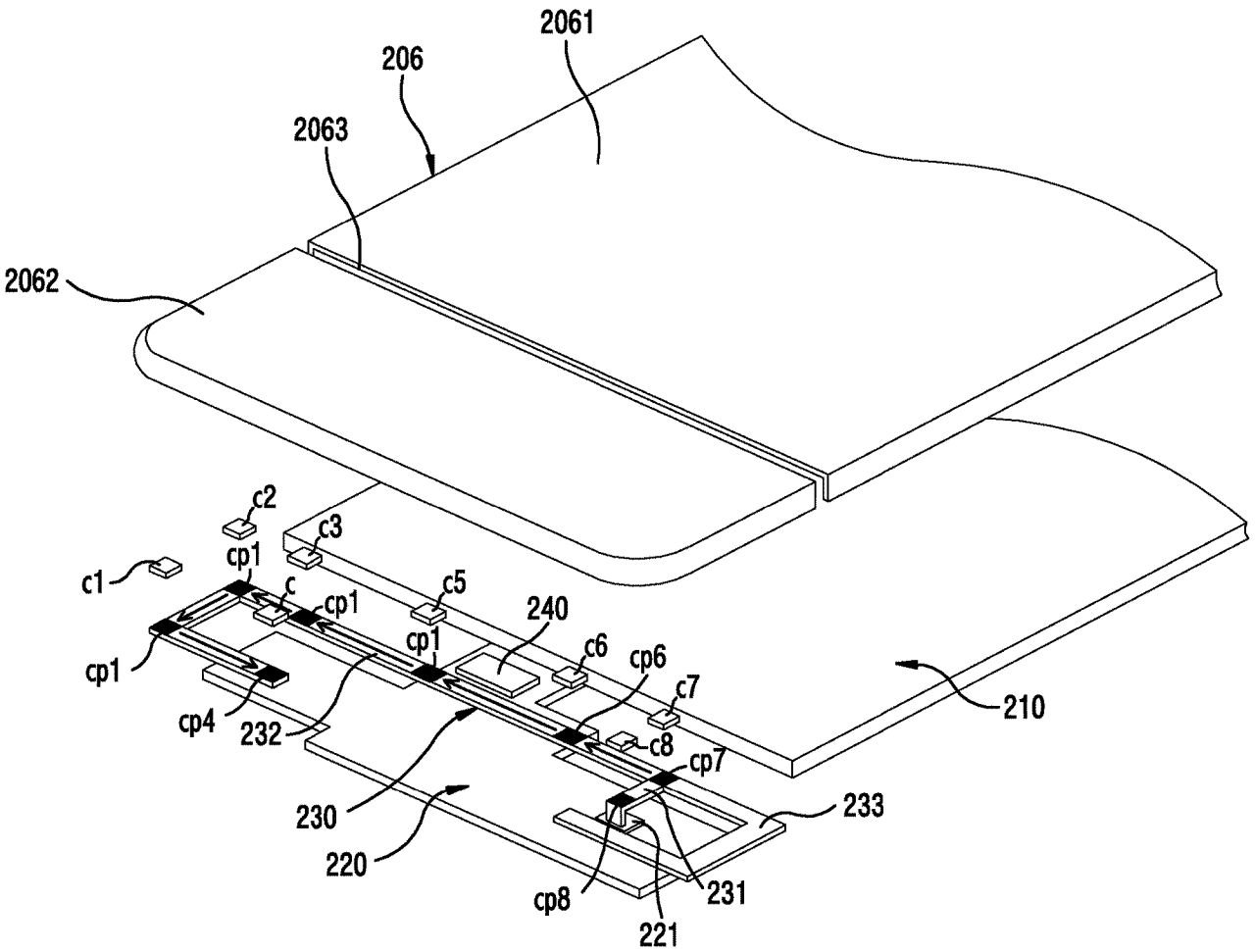
FIG. 3A is a perspective view of a portion of the electronic device of FIG. 1, according to various embodiments of the present disclosure.

FIG. 3A is a perspective view of a portion of the electronic device of FIG. 1, according to various embodiments of the present disclosure. In the example of FIG. 3A, a first radiation pattern 232 of the antenna radiator 230 is operated alone according to various embodiments of the present disclosure.

As illustrated in FIG. 3A, the electronic device 200 may include a substrate 210, a dielectric carrier 220, an antenna radiator 230 that includes one or more radiation patterns 232 and 233 arranged in the dielectric carrier 220, and a conductive cover 206 forming a metallic structure arranged around the antenna radiator 230. According to an embodiment, when the dielectric carrier 220 also functions as a substrate (for example, a PCB), the antenna radiator 230 may be formed on the dielectric carrier in a pattern form. According to an embodiment, when a separate substrate is present in addition to the dielectric carrier 220, some patterns of the antenna radiator 230 may be arranged in the dielectric carrier 220 and the remaining patterns thereof may be formed on the substrate.

According to various embodiments, the dielectric carrier (hereinafter, referred to as "a carrier") 220 may be a structure formed of a non-conductive material (for example, a synthetic resin) and may have a predetermined height. The antenna radiator 230 may be a metal plate arranged on an upper surface and a side surface of the carrier 220. According to an embodiment, the carrier 220 may be a substrate (in this case, a substrate that is separate from the substrate 210). For example, the antenna radiator 230 may be formed on an upper surface of the substrate in a pattern scheme. According to an embodiment, the antenna radiator 230 may be arranged on one surface of the carrier 220 or on two opposite surfaces of the carrier.

According to various embodiments, the antenna radiator 230 may be electrically connected to a feeding line formed in the substrate 210 through a feeding unit 221.

The antenna radiator 230 may include a first radiation pattern 232 and a second radiation pattern 233 that are branched to opposite sides with respect to the feeding pattern 231 fed to the feeding unit 221 and have predetermined shapes. However, the present disclosure is not limited thereto, and the antenna radiator 230 may include two or more radiation patterns. According to an embodiment, the feeding unit 221 may not have a separate pattern 231, and may make direct contact with a portion of the antenna radiator 230 to form several patterns.

According to various embodiments, an electric circuit 240 may be mounted on a feeding line positioned between the substrate 210 and the feeding unit 221 and a ground line. Additionally or alternatively, the electric circuit 240 may be mounted on the substrate 210 and/or the carrier 220. According to an embodiment, the electric circuit 240 may be a matching circuit by which a resonance frequency and an impedance of the antenna may be changed. According to an embodiment, the matching circuit may be an electric circuit (for example, an interdigital circuit or a lumped element) that compensates for changes in the physical length of the antenna (that occur when the conductive cover 206 is coupled to or decoupled from the antenna radiator 230) by changing the input impedance for a desired electrical wavelength. For example, the electric circuit may be: a passive circuit that includes an inductor L, a capacitor C or a combination of an inductor L and a capacitor C; a variable electric circuit (for example, a tunable IC) that includes a semiconductor element (for example, a diode, an FET, or a BJT) corresponding to an active element, a combination of an RF passive element and an active element; or a combination of interdigital circuits.

The conductive cover 206 may be a battery cover of the electronic device 200 (see FIG. 2B). However, the present disclosure is not limited thereto, and the conductive cover 206 may be part of any other portion of the housing of the electronic device 206.

According to an embodiment, the conductive cover 206 may include a main cover 2061 and a radiation cover 2062. The main cover 2061 and the radiation cover 2062 may be arranged to be spaced apart from each other by a gap 2063. According to an embodiment, the main cover 2061 and the radiation cover 2062 of the conductive cover 206 may be either integrally or separately formed. When they are integrally formed, a separate connecting filler (for example, a resin, a rubber, silicon, urethane, or a composite material) may be provided in the gap 2063 to connect the main cover 2061 and the radiation cover 2062. According to an embodiment, the main cover 2061 also may be utilized as an antenna radiator.

According to various embodiments, a plurality of contact points CP1, CP2, CP3, CP4, CP5, CP6, CP7, and CP8 are formed at a specific interval in the first radiation pattern 232 of the antenna radiator 230, and conductive contact elements (e.g., clips) C1, C2, C3, C4, C5, C6, C7, and C8 may be installed in the contact points CP1, CP2, CP3, CP4, CP5, CP6, CP7, and CP8. According to an embodiment, when the conductive cover 206 is installed in the electronic device, it may be electrically connected to the antenna radiator 230 by bringing an inner surface of the radiation cover 2062 into contact with at least one of the plurality of contact elements C1, C2, C3, C4, C5, C6, C7, and C8. According to an embodiment, the contact elements C1, C2, C3, C4, C5, C6, C7, and C8 may include conductive clips, conductive foam, or conductive patches.

According to various embodiments of the present disclosure, the electronic device 200 may use only the antenna radiator 230 as an antenna when the conductive cover 206 is not installed on the electronic device. Additionally or alternatively, when the conductive cover is mounted on the electronic device, the antenna radiator 230 and the radiation cover 2062 of the conductive cover 206 may operate in conjunction with one another to transmit and receive signals. As noted above, according to an embodiment, the electric circuit 240 may compensate for changes in the characteristics of an antenna (e.g., length, shape, etc.) that occur when the radiation cover 2062 is coupled to or decoupled from antenna radiator 230.

According to various embodiments, in FIG. 3A, when the conductive cover 206 is not mounted on the electronic device, the current flow of the antenna may be guided along the first radiation pattern 232 of the antenna radiator, as illustrated. According to an embodiment, as illustrated in FIG. 3A, the antenna may be operated at a band of 1 GHz.

Figure 3B:
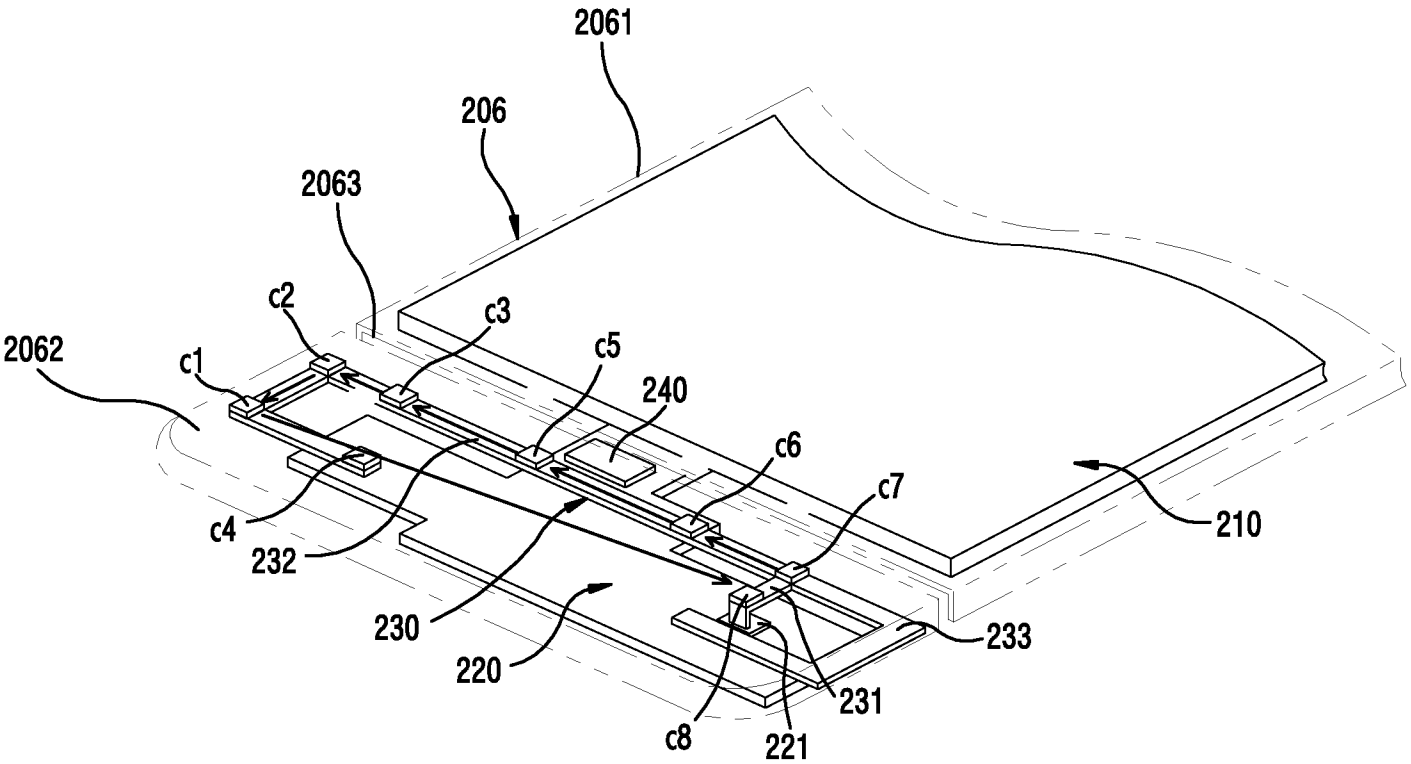
FIG. 3B is a perspective view of a portion of the electronic device of FIG. 1, according to various embodiments of the present disclosure.

FIG. 3B is a perspective view of a portion of the electronic device of FIG. 1, according to various embodiments of the present disclosure. More particularly, FIG. 3B illustrates an example in which a first radiation pattern 232 of an antenna radiator 230 is operated together with a radiation cover 2062, according to various embodiments of the present disclosure.

Hereinafter, a detailed description of the same elements as those of FIG. 3A will be omitted.

Referring to FIG. 3B, when the conductive cover 2062 is mounted on the electronic device, an inner surface of the conductive cover 206 may make contact with at least one of the contact elements C1, C2, C3, C4, C5, C6, C7, and C8 installed in the first radiation pattern 232 of the antenna radiator 230. In this case, the electrical flows of the antenna may be simultaneously guided from the feeding unit 221 of the antenna radiator 230 to the first radiation pattern 232 of the antenna radiator 230 and the radiation cover 2062 of the conductive cover 206. However, in this case, the current guide to the radiation cover 2062 is small and does not influence an operation of the antenna radiator. In this case, the antenna may also be operated at a band of 1 GHz.

According to an embodiment, the electric circuit 240 may variously change a matching value according the characteristics (for example, a change in impedance and the electrical length) of the antenna according to presence of the conductive cover 206 so that the antenna may be operated at a desired band (for example, a band of 1 GHz).

Figure 3C:
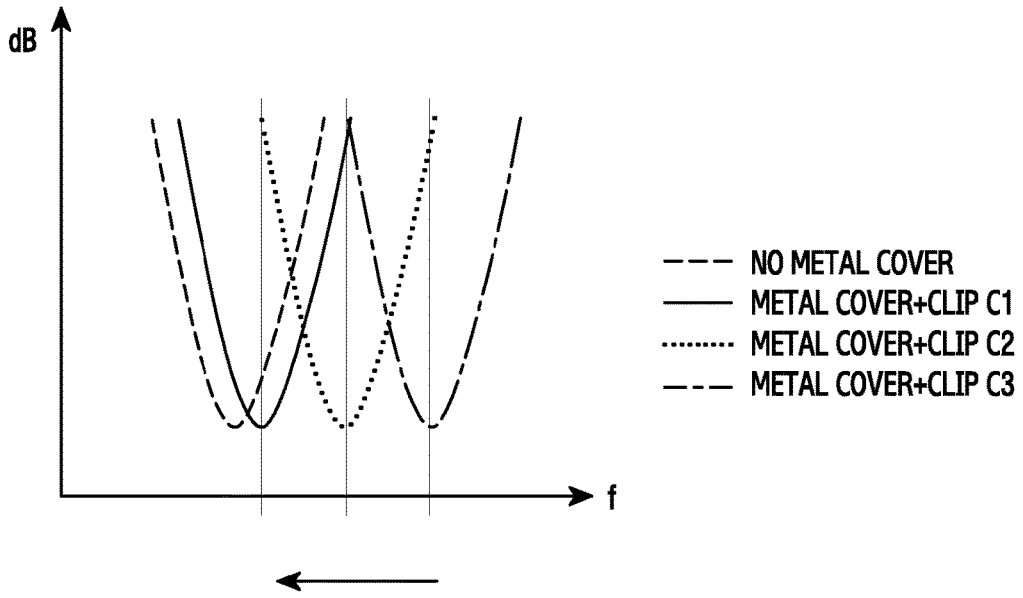
FIG. 3C is a graph illustrating a change in an operational frequency of an antenna radiator depending on the location of a contact element that connects the antenna radiator to a contact cover, according to various embodiments of the present disclosure.

FIG. 3C is a graph illustrating a change in an operational frequency of an antenna depending on the location of a contact element that connects an antenna radiator to a contact cover, according to various embodiments of the present disclosure.

According to various embodiments, electrical connection may be achieved using at least one of the contact elements C1, C2, C3, C4, C5, C6, C7, and C8 corresponding to at least one of the plurality of contact points CP1, CP2, CP3, CP4, CP5, CP6, CP7, and CP8 of the antenna radiator 230, and an operational frequency band of the antenna radiator may be shifted according to the locations of the contact element(s) that are used to establish the connection between the antenna radiator 230 and the conductive cover. According to an embodiment, when only the antenna radiator is used when the conductive cover is mounted on the electronic device 200, the intended operational frequency band of the antenna radiator may be changed by an interference caused by the conductive cover 206, and this may result in the radiation performance of the antenna radiator deteriorating. By contrast, when the conductive cover 206 is coupled to the antenna radiator 230, by one or more of the connectors C1-C8, an operational frequency band of the antenna radiator may be shifted to a preferred value by forming at least one point of contact (e.g., by using a contact element) between the conductive cover 206 the antenna radiator 230. Thus, integrating the conductive cover 206 into the pattern of the antenna radiator 230 may help avoid unnecessary interference from the conductive cover 206 while also improving the antenna performance of the electronic device 200.

As illustrated in FIG. 3C, the operational frequency band of the radiation body is increased as the contact point becomes closer to the feeding unit. Thus, in some embodiments, the location, in the antenna radiator 230, of one or more contact points (and/or) contact elements that couple the antenna radiator 230 to the contact cover 206 may be selected based on a desired (e.g., optimal) frequency band that is associated with a transceiver coupled to the antenna radiator 230.

Figure 3D:
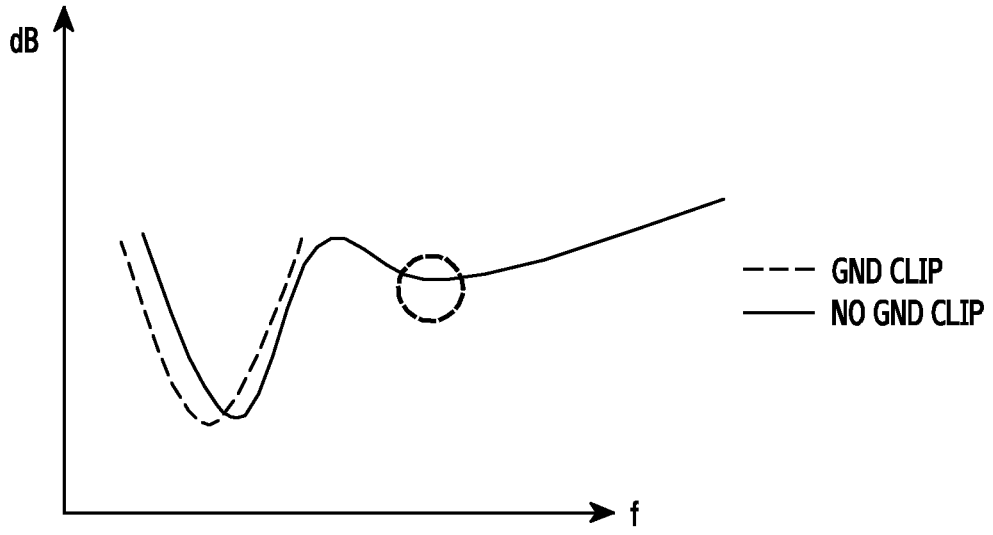
FIG. 3D is a graph illustrating a change in the operational frequency band of an antenna including an antenna radiator coupled to a contact cover, depending on whether the contact cover is grounded, according to various embodiments of the present disclosure.

FIG. 3D is a graph illustrating a change in the operational frequency band of an antenna including an antenna radiator coupled to a contact cover, depending on whether the contact cover is grounded. As illustrated in FIG. 3D, the efficiency of the antenna radiator deteriorates due to a parasite resonance when the peripheral conductive material floats. Accordingly, the conductive cover and the pattern of the antenna radiator may be electrically grounded by at least one separate contact element (for example, a GND clip).

Figure 3E:
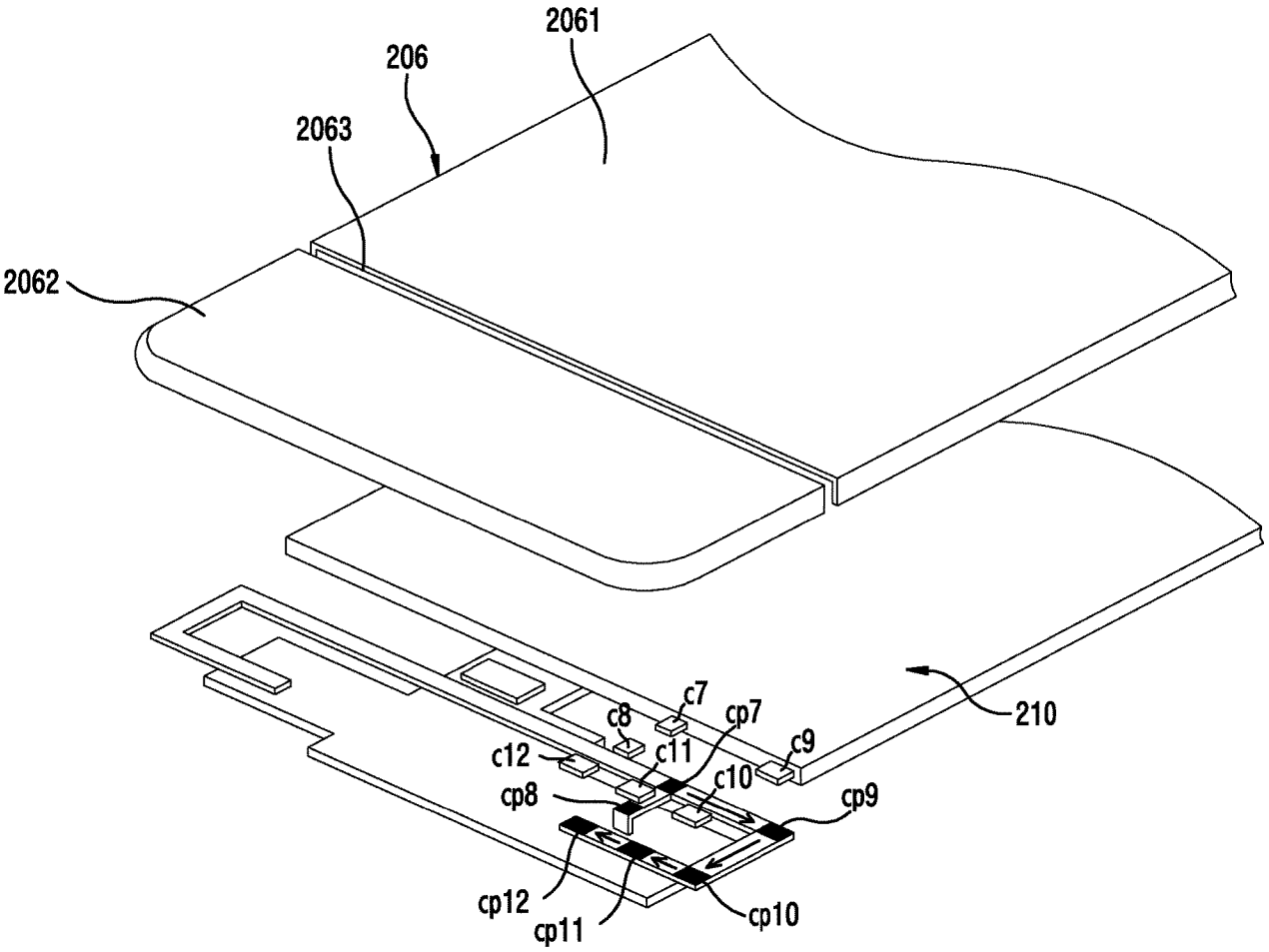
FIG. 3E is a perspective view of a portion of the electronic device of FIG. 1, according to various embodiments of the present disclosure.

FIG. 3E is a perspective view of a portion of the electronic device of FIG. 1, according to various embodiments of the present disclosure. More particularly, FIG. 3E illustrates an example in which a second radiation pattern 233 of an antenna radiator 230 is operated alone.

The configuration of the antenna of FIG. 3E is the same as that of FIG. 3A, and shows that a contact area with the conductive cover 206 is changed. Accordingly, a description of the same elements will be omitted.

As illustrated in FIG. 3E, a plurality of contact points CP7, CP8, CP9, CP10, CP11, and CP12 are formed in the second radiation pattern 233 of the antenna radiator 230 at a specific interval, and conductive contact elements C7, C8, C9, C10, C11, and C12 may be installed to correspond to the contact points CP7, CP8, CP9, CP10, CP11, and CP12. According to an embodiment, when the conductive cover 206 is installed in the electronic device, an inner surface of the radiation cover 2062 is brought into contact with at least one of the corresponding contact points CP7, CP8, CP9, CP10, CP11, and CP12 by at least one of the contact elements C7, C8, C9, C10, C11, and C12 so that the inner surface of the radiation cover 2062 may be electrically connected to the second radiation pattern 233 of the antenna radiator 230. According to an embodiment, the contact elements C7, C8, C9, C10, C11, and C12 also may be conductive clips, conductive foam, or conductive patches.

According to various embodiments of the present disclosure, only the antenna radiator 230 in the electronic device may be operated when the conductive cover 206 is not installed in the electronic device, and may interwork with the antenna radiator 230 and the radiation cover 2062 of the conductive cover 206 to be operated as a radiation body when the conductive cover 206 is installed in the electronic device. According to an embodiment, the electric circuit 240 may be operated to compensate for a change in characteristics (for example, an electrical (physical) length or an impedance) of an antenna that occur when the radiation cover 206 is installed.

According to various embodiments, in FIG. 4A, when the conductive cover 206 is not mounted on the electronic device, the current flow of the antenna may be guided along the second radiation pattern 233 of the antenna radiator 230 as illustrated. According to an embodiment, as illustrated in FIG. 4A, the antenna may be operated at a band of 2 GHz.

Figure 3F:
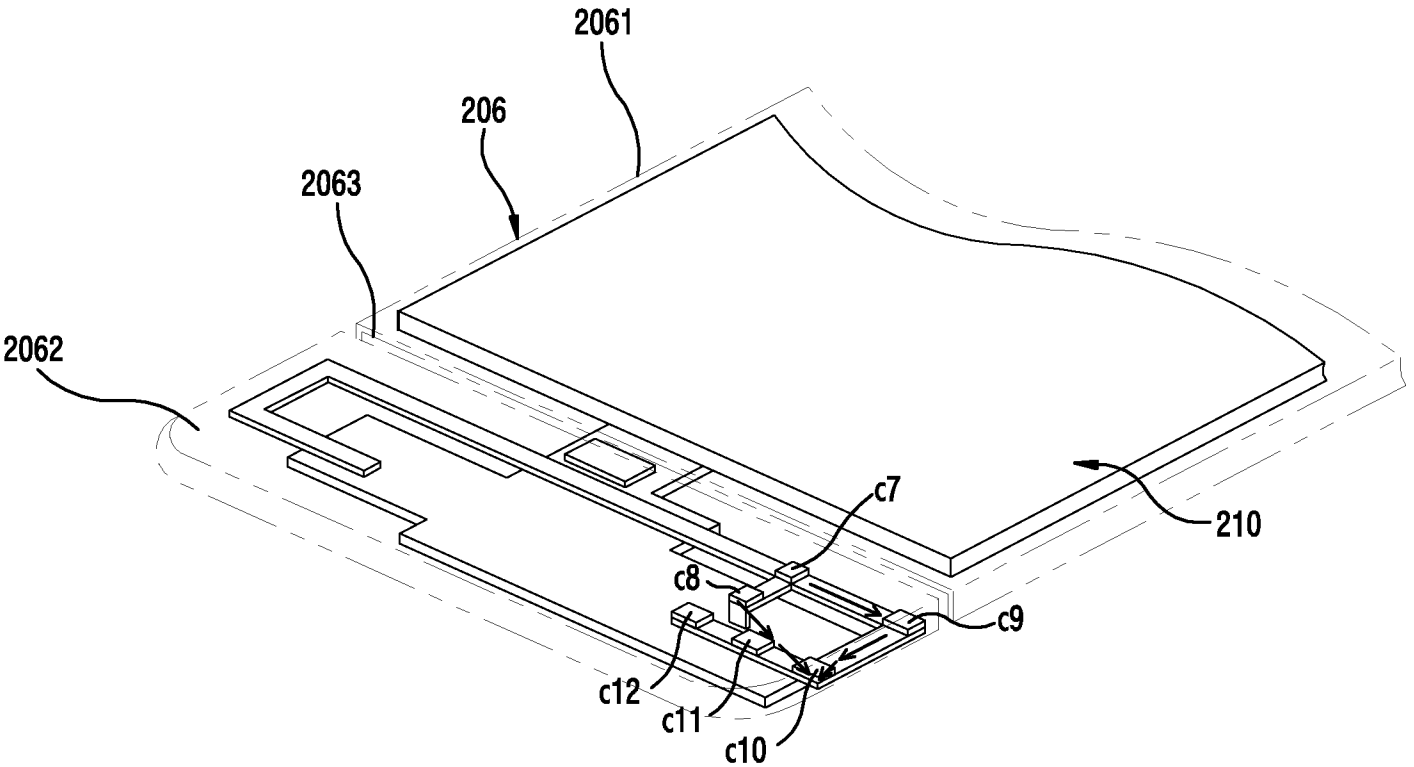
FIG. 3F is a perspective view of a portion of the electronic device of FIG. 1, according to various embodiments of the present disclosure.

FIG. 3F is a perspective view of a portion of the electronic device of FIG. 1, according to various embodiments of the present disclosure. More particularly, FIG. 3F illustrates an example in which the second radiation pattern 233 of the antenna radiator 230 is operated together with the radiation cover.

Hereinafter, a detailed description of the same elements as those of FIG. 3A will be omitted.

Referring to FIG. 3F, when the conductive cover 206 is installed in the electronic device, an inner surface of the conductive cover 206 may make contact with at least one of the contact elements C7, C8, C9, C10, C11, and C12 installed in the second radiation pattern 233 of the antenna radiator 230 and form an electrical connection. In this case, the electrical flows of the antenna may be simultaneously guided from the feeding unit 221 of the antenna radiator 230 to the second radiation pattern 232 of the antenna radiator 233 and the radiation cover 2062 of the conductive cover 206. However, in this case, the current guide to the radiation cover 2062 is small and does not influence an operation of the antenna radiator. In this case, the antenna also may be operated at a band of 2 GHz.

According to an embodiment, the electric circuit 240 may change a matching value to compensate for changes in the electrical length of the antenna that occur as a result of the conductive cover 206 being coupled to or decoupled from the antenna radiator 230, so that the antenna may be operated at a desired band (for example, a band of 2 GHz).

According to various embodiments, the radiation cover 2062 of the conductive cover 206 may be a plate type integral cover. According to an embodiment, a part of the conductive cover 206 may be formed in a radiation pattern scheme similar to the radiation patterns of the antenna radiator 203.

According to various embodiments, the radiation cover 2062 of the conductive cover 206 may be operated while being arranged at a distance by which the radiation cover 2062 may be connected to the antenna radiator by electrical coupling even though it does not make contact with the antenna radiator 230.

Figure 4C:
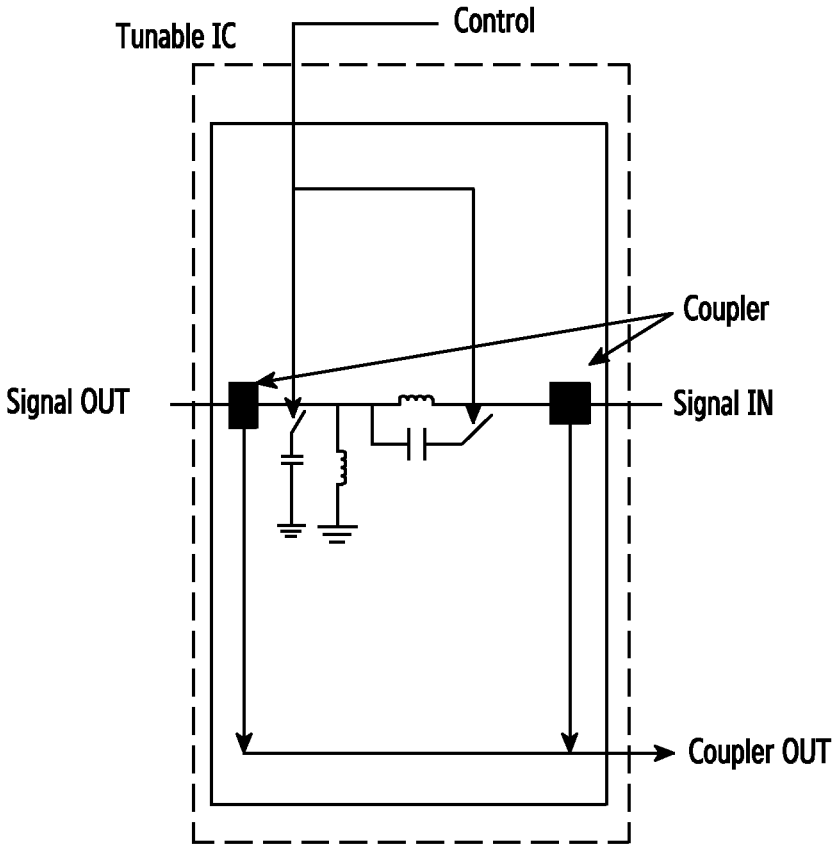
FIG. 4C is a diagram of an example of a circuit, according to various embodiments of the present disclosure.

FIG. 4A is a block diagram illustrating an electronic device employing an electric circuit (for example, a tunable IC) according to various embodiments of the present disclosure. FIGS. 4B and 4C are circuit diagrams of electric circuits according to various embodiments of the present disclosure.

According to various embodiments of the present disclosure, a desired operational frequency band of the antenna radiator may be varied by varying the location of the contact points (and/or connecting elements) that are used to couple the antenna radiator 230 to the contact cover 206, but also may be varied by a separate variable electrical circuit (for example, a tunable IC).

Referring to FIG. 4A, the electronic device is controlled by a Communication Processor (CP) 401 and the electronic circuit (hereinafter, referred to as "a tunable IC") 403 may be controlled by an RF front-end circuit 402. According to an embodiment, the tunable IC 403 is a variable matching circuit, and the operational frequency band of the antenna radiator 404 may be shifted by the matching circuit.

According to an embodiment, data generated by the communication processor may be transferred to the tunable IC via the RF front-end circuit. The tunable IC may generate losses due to a change in the frequency of the antenna radiator as a result of a change in the electronic device's surrounding environment (gripping of a hand of the user or an approach of a surrounding metallic object). According to an embodiment, when the communication processor detects that losses are generated, it may modify the operational frequency band of the antenna radiator by switching to another one of multiple matching paths that are available in the tunable IC, in order to maintain the operation of the antenna at a desirable band. According to an embodiment, the path may be one of independent matching path structures (1) and (2) as illustrated in FIG. 4B, or may be an added matching path structure of a main matching path as illustrated in FIG. 4C.

Figure 4D:
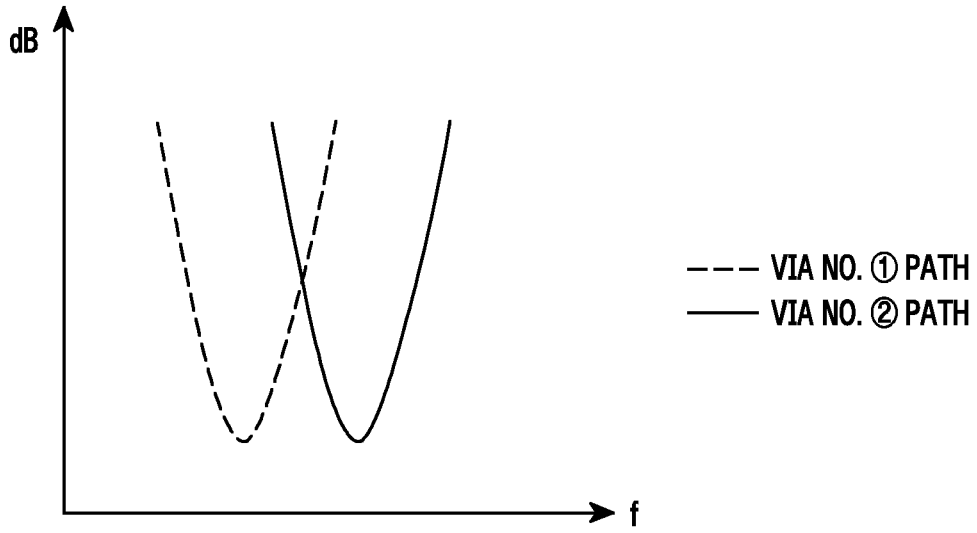

FIG. 4D is a graph depicting a change in the operational frequency band by the electric circuit of FIG. 4B in which an antenna radiator has an independent matching path, according to various embodiments of the present disclosure. As illustrated, the antenna radiator is operated in a higher frequency operation band in matching path No. 2 than in matching path No. 1.

FIG. 4E is a table illustrating different reductions in signal loss due to hand effect interference when an electric circuit (e.g., a tunable IC) is used, according to various embodiments of the present disclosure. As illustrated, the loss of the antenna radiator due to a hand effect of the user can be significantly reduced when the tunable IC is used.

According to various embodiments, the electronic device may change a contact point between the antenna radiator and the conductive cover in order to adjust a desired operational frequency band. Additionally or alternatively, the electronic device may automatically detect the operational frequency band using a variable electronic circuit (for example, a tunable IC) to adjust the operational frequency band to a desired value in correspondence to a change in the operational frequency band due to a change (for example, application of a conductive cover or gripping of a hand of the user) in the surrounding environment for the operational area of the antenna radiator.

FIGS. 5A and 5B are S11 graphs illustrating improvements in the efficiency of an antenna due to the presence of the radiation cover 206 according to various embodiments of the present disclosure. As illustrated, a frequency is only slightly shifted but there is no change in peak value and efficiency in the frequency bands when the first radiation pattern 232 and the second radiation pattern 233 of the antenna radiator 230 is operated alone (solid lines of FIGS. 5A and 5B) and when the radiation cover 206 is electrically connected to the radiation patterns 232 and 233 (dotted lines of FIGS. 5A and 5B).

According to an embodiment, in FIG. 5A, a part where the frequency characteristics are changed may be compensated for through the above-mentioned electric circuit 240.

FIG. 6 is an equivalent circuit diagram of an antenna employing a radiation cover according to various embodiments of the present disclosure.

Referring to FIG. 6, reference numeral 601 denotes feeding and ground tunable elements (electric circuits) for impedance matching, reference numeral 602 denotes an added pattern (the radiation cover), and reference numeral 603 denotes a radiation pattern of the antenna radiator.

The resonance of the antenna is most significantly influenced by the physical length, and the change in the physical length causes a frequency change ($f=1/\sqrt{(L_A C_A)}$) in $L_A$, $C_A$, and $R_A$ and generates a resonance at a specific frequency. When an antenna radiation pattern located within a metallic object surrounding an electronic device is connected to or separated from the metallic object $C_S$ or $L_S$, or the metallic object is damaged, the physical length of the antenna radiator is changed and an impedance and a resonance point generated by a basic radiation pattern (an internal antenna radiator) and an added pattern (a metallic object) through an electronic circuit (for example, a tunable element) that is connected to a feeding unit or the ground may be compensated for. The above description is merely an exemplary embodiment for impedance matching, and other circuits and structures may be used.

FIGS. 7A to 7C are diagrams of different examples of an antenna system, according to various embodiments of the present disclosure.

Referring to FIG. 7A, a conductive cover 700 may include two corresponding side surfaces 702 and 703 and an upper surface 701 connecting ends of the side surfaces 702 and 703. According to an embodiment, an antenna radiator 720 arranged in the carrier 710 may be electrically connected to the upper surface 701 of the conductive cover 700. According to an embodiment, when the dielectric carrier 710 functions as a substrate (for example, a PCB), the antenna radiator 720 may be formed on the sub-substrate in a pattern form. According to an embodiment, when a separate substrate is present in addition to the dielectric carrier 710, some patterns of the antenna radiator 720 may be arranged in the dielectric carrier 710 and the remaining patterns thereof may be formed on the substrate.

According to an embodiment, as described above, the antenna radiator 720 and the conductive cover 700 may be electrically connected to each other by a known contact element such as a C-clip, conductive foam, or a conductive patch.

Referring to FIG. 7B, a conductive cover 730 may include two corresponding side surfaces 732 and 733, and an upper surface 731 and a lower surface 734 connecting ends of the side surfaces 732 and 733. The two side surfaces 732 and 733, the upper surface 731, and the lower surface 734 may define an internal space of the electronic device.

According to an embodiment, an antenna radiator 750 may be arranged on and under the carrier 740, and may pass through the carrier 740. According to an embodiment, when the carrier 740 is a substrate, radiation patterns may be formed on an upper surface and a lower surface of the substrate and may be electrically connected to each other.

For example, the part of the antenna radiator 750 arranged on the carrier 740 may be electrically connected to the upper surface 731 of the conductive cover 730, and the part of the antenna radiator 750 arranged under the carrier 740 may be electrically connected to the lower surface 734 of the conductive cover 730.

Referring to FIG. 7C, a conductive cover 760 may include two corresponding side surfaces 762 and 763 and an upper surface 761 connecting ends of the side surfaces 762 and 763. According to an embodiment, an antenna radiator 780 may make contact with the side surface 763 of the radiation cover. According to an embodiment, when the antenna radiator 780 is formed in the PCB 770, a pattern may be formed on a side surface of the PCB.

According to various embodiments, the antenna radiator may make contact with a metallic structure of the electronic device in various schemes according to the shape of the electronic device and a location where the antenna is arranged in the electronic device.

According to various embodiments of the present disclosure, because the metallic structure may be used as an antenna, radiation performance can be improved and a restriction in a design of the electronic device can be excluded, and lowering of the radiation performance of the antenna can be prevented even though the metallic structure is removed or deformed.

FIG. 8 is a block diagram illustrating an electronic device according to various embodiments of the present disclosure.

Referring to FIG. 8, the electronic device 801 may, for example, correspond to the entire electronic device 101 shown in FIG. 1 or a part thereof. Referring to FIG. 8, the electronic device 801 may include at least one Application Processor (AP) 810, a communication module 820, a Subscriber Identifier Module (SIM) card 824, a memory 830, a sensor module 840, an input device 850, a display 860, an interface 870, an audio module 880, a camera module 891, a power management module 895, a battery 896, an indicator 897, and a motor 898.

The AP 810 may control a plurality of hardware or software elements connected to the AP 810 by driving an operating system or an application program and process various types of data including multimedia data and perform calculations. The AP 810 may be implemented as, for example, a System on Chip (SoC). According to an embodiment, the AP 810 may further include a Graphic Processing Unit (GPU).

The communication module 820 (for example, the communication interface 160) may perform data transmission/reception in communication between the electronic device 801 (for example, the electronic device 101) and other electronic devices (for example, the electronic device 104 and the server 106) connected thereto through a network. According to one embodiment, the communication module 820 may include a cellular module 821, a Wi-Fi module 823, a BT module 825, a GPS module 827, an NFC module 828, and a Radio Frequency (RF) module 829.

The cellular module 821 may provide a voice call, a video call, a text message service, or an Internet service through a communication network (e.g., LTE, LTE-A, CDMA, WCDMA, UMTS, WiBro, or GSM). Furthermore, the cellular module 821 may distinguish and authenticate electronic devices within a communication network, for example, using a subscriber identification module (e.g., the SIM card 824). According to an embodiment, the cellular module 821 may perform at least some functions which the AP 810 may provide. For example, the cellular module 821 may perform at least some of the multimedia control functions.

According to an embodiment, the cellular module 821 may include a Communication Processor (CP). In addition, the cellular module 821 may be implemented by, for example, a SoC. Although the elements such as the cellular module 821 (e.g., communication processor), the memory 830, and the power management module 895 are illustrated as separate elements from the AP 810 in FIG. 8, according to an embodiment, the AP 810 may be implemented so as to include at least some of the above elements (e.g., the cellular module 821).

According to an embodiment, the AP 810 or the cellular module 821 (for example, the communication processor) may load a command or data received from at least one of a non-volatile memory and other components connected thereto in a volatile memory, and may process the loaded command or data. Also, the AP 810 or the cellular module 821 may store, in a non-volatile memory, data received from or generated by at least one of other elements.

The Wi-Fi module 823, the BT module 825, the GPS module 827, and the NFC module 828 may include, for example, a processor for processing data transmitted/received through a corresponding module. Although the cellular module 821, the WiFi module 823, the BT module 825, the GPS module 827, and the NFC module 828 are illustrated as separate blocks in FIG. 8, at least some (for example, two or more) of the cellular module 821, the WiFi module 823, the BT module 825, the GPS module 827, and the NFC module 828 may be included in one Integrated Chip (IC) or one IC package in one embodiment. For example, at least some (for example, the communication processor corresponding to the cellular module 821 and the WiFi processor corresponding to the WiFi module 823) of the processors corresponding to the cellular module 821, the WiFi module 823, the BT module 825, the GPS module 827, and the NFC module 828 may be implemented as one SoC.

The RF module 829 may transmit/receive data, for example, an RF signal. Although not illustrated in the drawing, the RF module 829 may, for example, include a transceiver, a Power Amp Module (PAM), a frequency filter, a Low Noise Amplifier (LNA), or the like. Further, the RF module 829 may further include a component for transmitting/receiving electronic waves over a free air space in wireless communication, for example, a conductor, a conducting wire or the like. Although the cellular module 821, the WiFi module 823, the BT module 825, the GPS module 827, and the NFC module 828 share one RF module 829 in FIG. 8, at least one of the cellular module 821, the WiFi module 823, the BT module 825, the GPS module 827, and the NFC module 828 may transmit/receive an RF signal through a separate RF module in one embodiment.

The SIM card 824 may be a card including a subscriber identification module, and may be inserted into a slot formed in a particular portion of the electronic device. The SIM card 824 may include unique identification information (for example, an Integrated Circuit Card IDentifier (ICCID)) or subscriber information (for example, an International Mobile Subscriber IDentity (IMSI))

The memory 830 (for example, the memory 130) may include an internal memory 832 or an external memory 834. The internal memory 832 may include, for example, at least one of a volatile memory (e.g., a Dynamic RAM (DRAM), a Static RAM (SRAM), and a Synchronous Dynamic RAM (SDRAM)), and a non-volatile Memory (e.g., a One Time Programmable ROM (OTPROM), a Programmable ROM (PROM), an Erasable and Programmable ROM (EPROM), an Electrically Erasable and Programmable ROM (EEPROM), a mask ROM, a flash ROM, a NAND flash memory, and an NOR flash memory).

According to an embodiment, the internal memory 832 may be a Solid State Drive (SSD). The external memory 834 may further include a flash drive, for example, a compact flash (CF), a secure digital (SD), a micro secure digital (Micro-SD), a mini secure digital (Mini-SD), an extreme digital (xD), a Memory Stick, or the like. The external memory 834 may be functionally connected to the electronic device 801 through various interfaces. According to an embodiment, the electronic device 801 may further include a storage device (or storage medium) such as a hard drive.

The sensor module 840 may measure a physical quantity or detect an operation state of the electronic device 801, and may convert the measured or detected information to an electrical signal. The sensor module 840 may include at least one of, for example, a gesture sensor 840A, a gyro sensor 840B, an atmospheric pressure sensor 840C, a magnetic sensor 840D, an acceleration sensor 840E, a grip sensor 840F, a proximity sensor 840G, a color sensor 840H (e.g., a Red/Green/Blue (RGB) sensor), a bio-sensor 840I, a temperature/humidity sensor 840J, an illumination sensor 840K, and an Ultraviolet (UV) sensor 840M. Additionally or alternatively, the sensor module 840 may include, for example, an E-nose sensor (not illustrated), an electromyography (EMG) sensor (not illustrated), an electroencephalogram (EEG) sensor (not illustrated), an electrocardiogram (ECG) sensor (not illustrated), an Infrared (IR) sensor, an iris sensor (not illustrated), a fingerprint sensor, and the like. The sensor module 840 may further include a control circuit for controlling one or more sensors included in the sensor module 840.

The input device 850 may include a touch panel 852, a (digital) pen sensor 854, a key 856, or an ultrasonic input device 858. The touch panel 852 may recognize a touch input in at least one of, for example, a capacitive scheme, a resistive scheme, an infrared scheme, and an acoustic wave scheme. Further, the touch panel 852 may further include a control circuit. A capacitive touch panel may recognize a physical contact or proximity. The touch panel 852 may further include a tactile layer. In this event, the touch panel 852 may provide a tactile response to the user.

The (digital) pen sensor 854 may be embodied, for example, using a method identical or similar to a method of receiving a touch input from a user, or using a separate recognition sheet. The key 856 may include, for example, a physical button, an optical key, or a keypad. The ultrasonic input device 858 may identify data by detecting an acoustic wave with a microphone (for example, the microphone 888) of the electronic device 801, through an input unit generating an ultrasonic signal, and may perform wireless recognition. According to an embodiment, the electronic device 801 may receive a user input from an external device (for example, computer or server) connected thereto using the communication module 820.

The display 860 (for example, the display 150) may include a panel 862, a hologram device 864, or a projector 866. The panel 862 may be, for example, a Liquid Crystal Display (LCD) and an Active Matrix Organic Light Emitting Diode (AM-OLED) display, and the like. The panel 862 may be implemented to be, for example, flexible, transparent, or wearable. The panel 862 may include the touch panel 852 and one module. The hologram device 864 may show a stereoscopic image in the air by using interference of light. The projector 866 may project light onto a screen to display an image. The screen may be located, for example, inside or outside the electronic device 801. According to one embodiment, the display 860 may further include a control circuit for controlling the panel 862, the hologram device 864, or the projector 866.

The interface 870 may include, for example, a High-Definition Multimedia Interface (HDMI) 872, a Universal Serial Bus (USB) 874, an optical interface 876, or a D-sub-miniature (D-sub) 878. The interface 870 may be included in, for example, the communication interface 160 illustrated in FIG. 1. Additionally or alternatively, the interface 870 may include, for example, a Mobile High-definition Link (MHL) interface, a Secure Digital (SD) card/Multi-Media Card (MMC) interface, or an Infrared Data Association (IrDA) standard interface.

The audio module 880 may bilaterally convert a sound and an electrical signal. At least some components of the audio module 880 may be included in, for example, the input/output interface 140 illustrated in FIG. 1. The audio module 880 may process sound information input or output through, for example, the speaker 882, the receiver 884, the earphones 886, the microphone 888 or the like.

The camera module 891 is a device for capturing a still image or a video, and according to an embodiment, may include one or more image sensors (e.g., a front sensor or a rear sensor), a lens (not illustrated), an Image Signal Processor (ISP) (not illustrated), or a flash (not illustrated) (e.g., an LED or xenon lamp).

The power management module 895 may manage the power usage of the electronic device 801. Although not illustrated, the power management module 895 may include, for example, a Power Management Integrated Circuit (PMIC), a charger Integrated Circuit (IC), or a battery or fuel gauge.

The PMIC may be mounted to, for example, an integrated circuit or a SoC semiconductor. Charging methods may be classified into a wired charging method and a wireless charging method. The charger IC may charge a battery and may prevent an overvoltage or excess current from being induced or flowing from a charger. According to an embodiment of the present disclosure, the charger IC may include a charger IC for at least one of the wired charging method and the wireless charging method. A magnetic resonance scheme, a magnetic induction scheme, or an electromagnetic scheme may be exemplified as the wireless charging method, and an additional circuit for wireless charging, such as a coil loop circuit, a resonance circuit, a rectifier circuit, and the like may be added.

The battery gauge may measure, for example, a remaining quantity of the battery 896, or a voltage, a current, or a temperature during charging. The battery 896 may store or generate electricity, and may supply power to the electronic device 801 by using the stored or generated electricity. The battery 896 may include, for example, a rechargeable battery or a solar battery The indicator 897 may display a specific status of the electronic device 801 or a part (e.g. the AP 810) of electronic device, for example, a booting status, a message status, a charging status, and the like. The motor 898 can convert an electrical signal into a mechanical vibration. Although not illustrated, the electronic device 801 may include a processing unit (e.g., GPU) for supporting a mobile TV. The processing device for supporting mobile TV may process media data according to a standard of Digital Multimedia Broadcasting (DMB), Digital Video Broadcasting (DVB), media flow or the like.

Each of the above-described elements of the electronic device according to various embodiments of the present disclosure may include one or more components, and the name of a corresponding element may vary according to the type of electronic device. The electronic device according to various embodiments of the present disclosure may include at least one of the above-described elements, and may exclude some of the elements or further include other additional elements. Further, some of the components of the electronic device according to the various embodiments of the present disclosure may be combined to form a single entity, and thus, may equivalently execute functions of the corresponding elements prior to the combination.

The "module" used in various embodiments of the present disclosure may refer to, for example, a "unit" including one of hardware, software, and firmware, or a combination of two or more of the hardware, software, and firmware. The "module" may be interchangeable with a term, such as a unit, a logic, a logical block, a component, or a circuit. The "module" may be a minimum unit of an integrated component element or a part thereof. The "module" may be the smallest unit that performs one or more functions or a part thereof. The "module" may be mechanically or electronically implemented. For example, the "module" according to various embodiments of the present disclosure may include at least one of an Application-Specific Integrated Circuit (ASIC) chip, a Field-Programmable Gate Arrays (FPGAs), and a programmable-logic device for performing operations which have been known or are to be developed hereafter.

According to various embodiments, at least some of the devices (e.g., modules or functions thereof) or methods (e.g., operations) according to the various embodiments of the present disclosure may be implemented as, for example, instructions stored computer readable storage media in the form of programming modules. When the command is executed by one or more processors (for example, the processor 810), the one or more processors may execute a function corresponding to the command. The computer-readable storage medium may be, for example, the memory 220. At least a part of the programming module may be implemented (for example, executed) by, for example, the processor 810. At least some of the programming modules may include, for example, a module, a program, a routine, a set of instructions or a process for performing one or more functions.

The computer readable recording medium may include magnetic media such as a hard disc, a floppy disc, and a magnetic tape, optical media such as a compact disc read-only memory (CD-ROM) and a digital versatile disc (DVD), magneto-optical media such as a floptical disk, and hardware devices specifically configured to store and execute program commands, such as a read-only memory (ROM), a random-access memory (RAM), and a flash memory. In addition, the program instructions may include high-class language codes, which can be executed by a computer by using an interpreter, as well as machine codes made by a compiler. The aforementioned hardware device may be configured to operate as one or more software modules in order to perform the operation of various embodiments of the present disclosure, and vice versa.

A module or a programming module according to various embodiments of the present disclosure may include at least one of the above-described elements, may exclude some of the elements, or may further include other additional elements. Operations executed by a module, a programming module, or other component elements according to various embodiments of the present disclosure may be executed sequentially, in parallel, repeatedly, or in a heuristic manner. Further, some operations may be executed according to another order or may be omitted, or other operations may be added.

FIGS. 1-8 are provided as an example only. At least some of the operations discussed with respect to these figures can be performed concurrently, performed in a different order, and/or altogether omitted. It will be understood that the provision of the examples described herein, as well as clauses phrased as "such as," "e.g.", "including", "in some aspects," "in some implementations," and the like should not be interpreted as limiting the claimed subject matter to the specific examples.

The above-described aspects of the present disclosure can be implemented in hardware, firmware or via the execution of software or computer code that can be stored in a recording medium such as a CD-ROM, a Digital Versatile Disc (DVD), a magnetic tape, a RAM, a floppy disk, a hard disk, or a magneto-optical disk or computer code downloaded over a network originally stored on a remote recording medium or a non-transitory machine-readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer. No claim element herein is to be construed under the provisions of 35 U.S.C. 112, sixth paragraph, unless the element is expressly recited using the phrase "means for".

While the present disclosure has been particularly shown and described with reference to the examples provided therein, it will be understood by those skilled in the art that various changes in form and details may be made therein without departing from the spirit and scope of the present disclosure as defined by the appended claims.

What is claimed is:

1. An electronic device comprising:

a housing;

a wireless communication transceiver provided within the housing;

an antenna radiator provided within the housing;

a variable passive element provided in the housing; and a conductive cover of a metallic material arranged to cover at least a portion of the antenna radiator and form at least a portion of the housing, wherein the cover includes a conductive material physically connected by a conductive path to the antenna radiator, and the conductive cover is at least partially detachable from the housing, wherein the antenna radiator includes a plurality of contacts disposed at predetermined intervals and physically contacting the conductive cover, and wherein at least one of the plurality of contacts is electrically connected with the conductive cover, wherein the conductive cover and the antenna radiator have a resonant frequency, and wherein the variable passive element is configured to cause the antenna radiator to have the resonant frequency when the conductive cover is disconnected or completely removed.

2. The electronic device of claim 1, wherein the antenna radiator includes a first portion that is inserted into an injection-molded object, and a second portion exposed from the injection molded object, wherein the exposed second portion is in direct contact with the conductive material.

3. The electronic device of claim 1, wherein the cover includes a first flat surface and a second curved surface.

4. The electronic device of claim 1, wherein the variable passive element includes at least one of a variable capacitor and a variable inductor.

5. The electronic device of claim 1, further comprising: a control circuit arranged to generate a control signal for changing a state of the variable passive element.

6. The electronic device of claim 5, wherein the control circuit is arranged to generate the control signal in response to the cover being at least partially detached from the housing.

7. The electronic device of claim 1, wherein the antenna radiator and the conductive material are connected by at least one of a C-clip, conductive foam, and a conductive patch.

8. The electronic device of claim 1, wherein the antenna radiator and the conductive material have a common ground.

* * * * *